US010585367B2

(12) United States Patent
Yamagishi et al.

(10) Patent No.: US 10,585,367 B2
(45) Date of Patent: Mar. 10, 2020

(54) ELECTROSTATIC CHARGE IMAGE DEVELOPING TONER AND ELECTROSTATIC CHARGE IMAGE DEVELOPER

(71) Applicant: FUJI XEROX CO., LTD., Tokyo (JP)

(72) Inventors: Yuka Yamagishi, Minamiashigara (JP); Moegi Iguchi, Minamiashigara (JP); Yutaka Saito, Minamiashigara (JP); Mona Tasaki, Minamiashigara (JP); Soutaro Kakehi, Minamiashigara (JP); Sakon Takahashi, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/105,044

(22) Filed: Aug. 20, 2018

(65) Prior Publication Data

US 2019/0294068 A1 Sep. 26, 2019

(30) Foreign Application Priority Data

Mar. 22, 2018 (JP) ..... 2018-054946

(51) Int. Cl.
*G03G 9/097* (2006.01)
*G03G 9/087* (2006.01)

(52) U.S. Cl.
CPC ..... *G03G 9/09708* (2013.01); *G03G 9/08755* (2013.01); *G03G 9/09716* (2013.01)

(58) Field of Classification Search
CPC ..... G03G 9/09708; G03G 9/08755
See application file for complete search history.

(56) References Cited

U.S. PATENT DOCUMENTS 5,948,582 A * 9/1999 Nakamura ..... G03G 9/0819 430/110.3
2006/0110673 A1* 5/2006 Bae ..... G03G 9/09708 430/108.6
2015/0268576 A1 9/2015 Saito et al.
2017/0242356 A1 8/2017 Saito et al.

FOREIGN PATENT DOCUMENTS

JP 2008-58463 A 3/2008
JP 2010-20054 A 1/2010
JP 2017-146538 A 8/2017

OTHER PUBLICATIONS

Search Report dated Jan. 29, 2019 by the European Patent Office in counterpart European Patent Application No. 18192164.4.

* cited by examiner

*Primary Examiner* — Thorl Chea
(74) *Attorney, Agent, or Firm* — Sughrue Mion, PLLC

(57) ABSTRACT

Provided is an electrostatic charge image developing toner including: toner particles; and strontium titanate particles A and strontium titanate particles B having different average primary particle diameters from each other. The strontium titanate particles B have an average primary particle diameter Db of 10 nm to 100 nm. An average primary particle diameter Da of the strontium titanate particles A and the average primary particle diameter Db of the strontium titanate particles B satisfy a relationship of $10 \leq Da/Db \leq 100$.

17 Claims, 3 Drawing Sheets

ELECTROSTATIC CHARGE IMAGE DEVELOPING TONER AND ELECTROSTATIC CHARGE IMAGE DEVELOPER

CROSS-REFERENCE TO RELATED APPLICATION(S)

This application is based on and claims priority under 35 USC 119 from Japanese Patent Application No. 2018-054946 filed Mar. 22, 2018.

BACKGROUND

Technical Field

The present disclosure relates to an electrostatic charge image developing toner and an electrostatic charge image developer.

Related Art

JP-A-2010-020054 discloses a toner, which contains: a toner particle; an inorganic fine powder (A) which has an average primary particle diameter of 30 nm to 300 nm, has a particle shape of a cubic shape and/or a rectangular parallelepiped shape, and the surface thereof is not treated with a fatty acid or fatty acid metal salt; and an inorganic fine powder (B) which has an average-primary particle diameter of 30 nm to 300 nm, has a particle shape of a cubic shape and/or a rectangular parallelepiped shape, and the surface thereof is treated with a fatty acid or fatty acid metal salt.

JP-A-2017-146538 discloses a toner, which contains: a toner particle; an abrasive particle having a number particle size distribution with two peaks; and a fatty acid metal salt particle having a number particle size distribution with one peak.

SUMMARY

Aspects of non-limiting embodiments of the present disclosure relate to provide an electrostatic charge image developing toner which suppresses contamination of an image holder and contamination of an intermediate transfer member, as compared with a case where a ratio Da/Db of an average primary particle diameter Da of the strontium titanate particles A and an average primary particle diameter Db of the strontium titanate particles B, both of which are contained in the electrostatic charge image developing toner, is less than 10 or more than 100.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image developing toner including:

toner particles; and strontium titanate particles A and strontium titanate particles B having different average primary particle diameters from each other, wherein the strontium titanate particles B have an average primary particle diameter Db of 10 nm to 100 nm, and an average primary particle diameter Da of the strontium titanate particles A and the average primary particle diameter Db of the strontium titanate particles B satisfy a relationship of $10 \leq Da/Db \leq 100$.

BRIEF DESCRIPTION OF DRAWINGS

Exemplary embodiment(s) of the present disclosure will be described in detail based on the following figures, wherein.

DETAILED DESCRIPTION

Figure 1A:
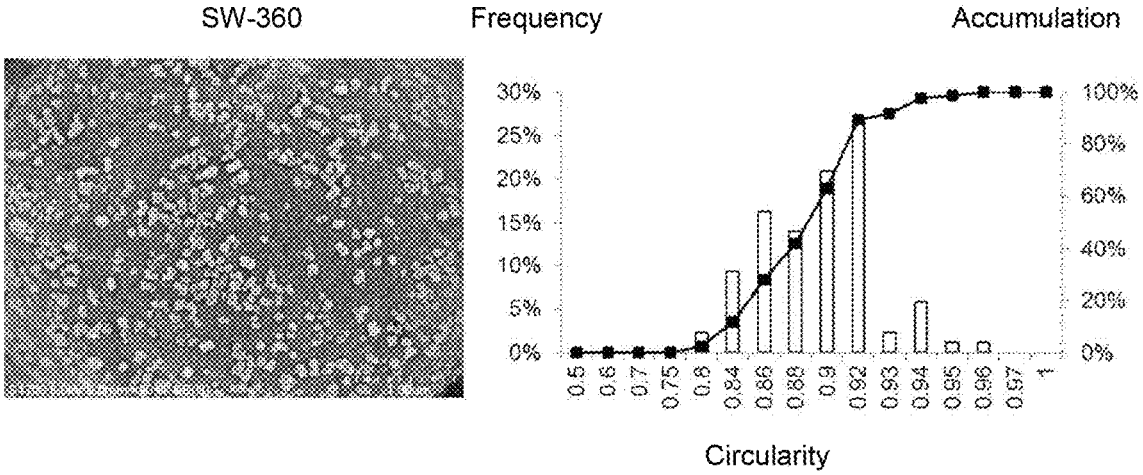
FIG. 1A is an SEM image of a toner externally added with SW-360 manufactured by Titan Kogyo, Ltd., which is an example of a strontium titanate particle, and a graph of circularity distribution of the strontium titanate particle obtained by analyzing the SEM image.

Hereinafter, exemplary embodiments of the present disclosure are described. These descriptions and examples are illustrative of exemplary embodiments and do not limit the scope of the invention.

In the present disclosure, in a case of referring to the amount of each component in a composition, when there are a plurality of kinds of substances corresponding to each component in the composition, it means the total amount of the plurality of kinds of substances present in the composition, unless otherwise specified.

In the present disclosure, a numerical value indicated by using "to" indicates a range including the numerical values described before and after "to" as the minimum value and the maximum value, respectively.

In the present disclosure, the "electrostatic charge image developing toner" is simply referred to as "toner", and the "electrostatic charge image developer" is simply referred to as "developer".

<Electrostatic Charge Image Developing Toner>

A toner according to a first embodiment contains: toner particles; and strontium titanate particles A and a strontium titanate particles B having different average primary particle diameters from each other, in which the strontium titanate particles B have an average primary particle diameter of 10 nm to 100 nm, and a Da/Db ratio of an average primary particle diameter Da of the strontium titanate particle A to an average primary particle diameter Db of the strontium titanate particles B is 10 to 100.

A toner according to a second embodiment contains: toner particles; and strontium titanate particles A and strontium titanate particles B having different average primary particle diameters from each other, in which the strontium titanate particles B have an average primary particle circularity of 0.82 to 0.94 and a circularity that becomes 84% of accumulation of greater than 0.92, and a Da/Db ratio of an average primary particle diameter Da of the strontium titanate particles A to an average primary particle diameter Db of the strontium titanate particles B is 10 to 100.

A toner according to a second embodiment contains: toner particles; and strontium titanate particles A and strontium titanate particles B having different average primary particle diameters from each other, in which a full width at half maximum of a peak of a 110 plane obtained by an X-ray diffraction method from the strontium titanate particles B is 0.2° to 2.0°, and a Da/Db ratio of an average primary particle diameter Da of the strontium titanate particles A to an average primary particle diameter Db of the strontium titanate particles B is 10 to 100.

Hereinafter, matters common to the first embodiment, the second embodiment and the third embodiment are generically described as the present embodiment.

The toner according to the present embodiment contains both the strontium titanate particles A having larger particle diameters and the strontium titanate particles B having smaller particle diameters. When the ratio Da/Db of the average primary particle diameters of the two kinds of particles is 10 to 100, it is estimated that contamination of an image holder and contamination of an intermediate transfer member are suppressed. Although the mechanism is not clear, it is estimated as follows. In the following description, the image holder is referred to as "photoreceptor".

When image formation is continued, discharge products and the like are adhered to surfaces of the photoreceptor and the intermediate transfer member, which are included in an electrophotographic image forming apparatus, and thus the surfaces of these members may be contaminated. Conventionally, as an abrasive for scraping these adhered substances, various particles are externally added to the toner. For example, a titanium oxide particle, a strontium titanate particle, or the like can be used. The strontium titanate particles have a property of being harder to be buried into the toner particles than the titanium oxide particles since they have an electrical affinity relationship with the toner particle.

When the image formation is continuously performed, a color strip may occur on a record medium. This is thought to be due to accumulation of the adhered substances on the intermediate transfer member. The color strip is significant in a case of contiguously forming images having large areas under a high temperature and high humidity environment. As a mechanism for accumulating the adhered substances on the intermediate transfer member, most of the abrasive contained in the toner is released from the toner particles on the photoreceptor, so that the amount of the abrasive supplied to the intermediate transfer member is insufficient, and it is thought that abrasion of the adhered substances attached to the intermediate transfer member is suppressed.

In respect to the above events, in the present embodiment, both the strontium titanate particles A having larger particle diameters and the strontium titanate particles B having smaller particle diameters are used as external additives of the toner. The large-diameter strontium titanate particles A which are not easier to be released from the toner particles are supplied to a surface of the photoreceptor which has more adhered substances and requires a strong abrasion effect, so that the abrasion function is exerted. On the other hand, the small-diameter strontium titanate particles B which are harder to be released from the toner particles are not released on the photoreceptor but migrate to the intermediate transfer member while adhering to the toner particles and are supplied to the surface of the intermediate transfer member, so that the abrasion function is exerted. The strontium titanate has a property of being harder to be buried into the toner particles than the titanium oxide particles since they have an electrical affinity relationship with the toner particles. Therefore, it is estimated that the strontium titanate particles B efficiently exert the abrasion function on the surface of the intermediate transfer member.

In the present embodiment, the ratio Da/Db of the average primary particle diameters of the strontium titanate particles A and the strontium titanate particles B is 10 to 100. When the Da/Db is less than 10 or more than 100, the amount of the strontium titanate particles supplied to the photoreceptor and the amount of the strontium titanate particles supplied to the intermediate transfer member cannot be balanced, the abrasive effect in either one of them is insufficient and the adhered substances are easy to accumulate.

From the above viewpoints, in the present embodiment, the Da/Db is 10 to 100, more preferably 10 to 80, till more preferably 15 to 50, and even more preferably 20 to 50.

In the toner according to the first embodiment, the strontium titanate particles B have an average primary particle diameter of 10 nm to 100 nm. The strontium titanate particles B have a size of appropriate range: since not too large, it is easy to migrate to the intermediate transfer member while adhering to the toner particle; and since not too small, it is hard to be buried into the toner particle. Therefore, it is estimated that the strontium titanate particles B is one efficiently exerting the abrasion function on the surface of the intermediate transfer member.

In the toner according to the first or third embodiment, from the above viewpoints, it is preferable that the strontium titanate particles B has an average primary particle diameter of 10 nm to 100 nm.

In the toner according to the second embodiment, the strontium titanate particles B have an average primary particle circularity of 0.82 to 0.94 and a circularity that becomes 84% of accumulation of greater than 0.92. This means that the shapes of the strontium titanate particles B are round shapes (which are described in detail below). Since the strontium titanate particles B have round shapes, they are highly uniformly dispersed on the toner particle, it is easy to migrate to the intermediate transfer member while adhering to the toner particle, and it is hard to be released from the toner particle on the intermediate transfer member. Therefore, it is estimated that the strontium titanate particles B are one efficiently exerting the abrasion function on the surface of the intermediate transfer member.

In the toner according to the first or third embodiment, from the above viewpoints, it is preferable that the strontium titanate particles B have an average primary particle circularity of 0.82 to 0.94 and a circularity that becomes 84% of accumulation of the primary particle of greater than 0.92.

In the toner according to the third embodiment, the strontium titanate particles B have a full width at half maximum of a peak of a 110 plane obtained by an X-ray diffraction method is 0.2° to 2.0°. This means that the shapes of the strontium titanate particles B are round shapes (which are described in detail below). Since the strontium titanate particles B have round shapes, they are highly uniformly dispersed on the toner particles, it is easy to migrate to the intermediate transfer member while adhering to the toner particle, and it is hard to be released from the toner particles on the intermediate transfer member. Therefore, it is estimated that the strontium titanate particles B are one efficiently exerting the abrasion function on the surface of the intermediate transfer member.

In the toner according to the first or second embodiment, from the above viewpoints, it is preferable that the strontium titanate particles B have a full width at half maximum of a peak of a 110 plane obtained by the X-ray diffraction method is 0.2° to 2.0°.

Hereinafter, the configuration of the toner according to the present embodiment is described in detail.

[Strontium Titanate Particle A]

In the present embodiment, from the viewpoints of being easy to release from the toner particle on the photoreceptor and of being easy to migrate to the intermediate transfer member, the strontium titanate particles A preferably have an average primary particle diameter of 0.8 μm to 3.5 μm, more preferably 1.0 μm to 3.0 μm, still more preferably 1.0 μm to 2.5 μm, and even more preferably 1.25 μm to 2.5 μm.

In the present embodiment, the primary particle diameter of the strontium titanate particles A is a diameter of a circle having the same area as the primary particle image (so-called circle equivalent diameter). The average primary particle diameter of the strontium titanate particles A is a particle diameter that becomes 50% of accumulation from a small diameter side in the number-based distribution of the primary particle diameter. The primary particle diameter of the strontium titanate particles A is obtained by image analysis of at least 300 strontium titanate particles A.

The average primary particle diameter of the strontium titanate particles A can be controlled, for example, according to various conditions in producing the strontium titanate particle by a wet process.

In the present embodiment, from the viewpoints of being easy to release from the toner particle on the photoreceptor and of being easy to migrate to the intermediate transfer member, it is preferable that the average primary particle diameter of the strontium titanate particle A is smaller than the volume average particle diameter of the toner particle.

The D50v/Da, which is a ratio of the volume average particle diameter D50v of the toner particle to the average primary particle diameter Da of the strontium titanate particle A, is preferably 1.3 to 7.0, more preferably 1.6 to 7.0, and still more preferably 2.0 to 7.0.

In the present embodiment, from the viewpoint of improving the effect of the strontium titanate particle A, it is preferable that the strontium titanate particles A are strontium titanate particles having a surface not hydrophobically treated.

In the present embodiment, the strontium titanate particle A preferably has a specific volume resistivity Ra (Ω·cm) of 5 to 10, more preferably 6 to 10, and still more preferably 7 to 9, in terms of a common logarithm value log Ra.

The specific volume resistivity R of the strontium titanate particle is measured as follows.

The strontium titanate particle is placed on a lower electrode plate of a measurement tool so as to form a flat layer having a thickness in a range of 1 mm to 2 mm, the measurement tool being a pair of 20 $cm^2$ circular electrode plates (made of steel) connecting an electrometer (Keithley 610C manufactured by Keithley Instruments) and a high-voltage power supply (Fluke 415B manufactured by Fluke Corporation). Next, the humidity is controlled for 24 hours in an environment of a temperature of 22° C. and a relative humidity of 55%. Subsequently, under the environment of a temperature of 22° C. and a relative humidity of 55%, an upper electrode plate is disposed on the strontium titanate particle layer, 4 kg weight is placed on the upper electrode plate to remove the void in the strontium titanate particle layer, and in that state, the thickness of the strontium titanate particle layer is measured. Then, a voltage of 1000 V is applied to both the electrode plates to measure the current value, and the specific volume resistivity R is calculated from the following Formula (1).

$$\text{Specific volume resistivity } R\ (\Omega\cdot\text{cm}) = V \times S/(A1-A0)/d \quad \text{Formula (1):}$$

In Formula (1), V is the applied voltage 1000 (V), S is the electrode area 20 ($cm^2$), A1 is the measured current value (A), A0 is the initial current value (A) when the applied voltage is 0 V, and d is the thickness (cm) of the strontium titanate particle layer.

The content of the strontium titanate particle A contained in the toner according to the present embodiment is preferably 0.02 part by mass to 1 part by mass, more preferably 0.02 part by mass to 0.7 part by mass, and still more preferably 0.02 part by mass to 0.5 part by mass, based on 100 parts by mass of the toner particle.

[Strontium Titanate Particle B]

In the present embodiment, it is preferable that the strontium titanate particle B has an average primary particle diameter of 10 nm to 100 nm. When the average primary particle diameter of the strontium titanate particle is less than 10 nm, the strontium titanate particle is easy to be buried into the toner particle and is hard to exert the abrasion function on the surface of the intermediate transfer member. When the average primary particle diameter of the strontium titanate particle is more than 100 nm, the strontium titanate particle is easy to release on the photoreceptor, and the amount of the abrasive supplied to the intermediate transfer member is reduced.

From the above viewpoints, the average primary particle diameter of the strontium titanate particle B is preferably 10 nm to 100 nm, more preferably 20 nm to 90 nm, still more preferably 30 nm to 80 nm, and even more preferably 30 nm to 60 nm.

In the present embodiment, the primary particle diameter of the strontium titanate particle B is a diameter of a circle having the same area as the primary particle image (so-called circle equivalent diameter). The average primary particle diameter of the strontium titanate particle B is a particle diameter that becomes 50% of accumulation from a small diameter side in the number-based distribution of the primary particle diameter. The primary particle diameter of the strontium titanate particle B is obtained by image analysis of at least 300 strontium titanate particles B.

The average primary particle diameter of the strontium titanate particle B can be controlled, for example, according to various conditions in producing the strontium titanate particle by a wet process.

In the present embodiment, from the viewpoint of efficiently exerting the abrasion function on the surface of the intermediate transfer member, it is preferable that the strontium titanate particles B have a shape of a cubic or rectangular parallelepiped shape, and also a round shape.

The strontium titanate particles have a crystal structure of perovskite structure, and usually the particle shape is a cubic shape or a rectangular parallelepiped shape. However, since the strontium titanate particles having a cubic or rectangular parallelepiped shape, i.e., the strontium titanate particles having angles, is adhere to the toner particle with the angles thereof stuck into the toner particles, it is estimated that the strontium titanate particles are hard to release from the toner particles on the intermediate transfer member. In order to efficiently exert the abrasion function on the surface of the intermediate transfer member, it is preferable that the strontium titanate particles B have a shape which is easy for the strontium titanate particles B to release from the toner particle on the intermediate transfer member. Therefore, it is preferable that the strontium titanate particles B have a shape having few angles, i.e., a round shape.

In the present embodiment, it is preferable that the strontium titanate particles B have an average primary particle circularity of 0.82 to 0.94 and a circularity that becomes 84% of the primary particle of accumulation of greater than 0.92.

In the present embodiment, the circularity of the primary particle in the strontium titanate particle B is $4\pi\times$(area of primary particle image)/(perimeter of primary particle image)$^2$. The average primary particle circularity is a circularity that becomes 50% of accumulation from a small side in the circularity distribution. The circularity that becomes 84% of the primary particle of accumulation is a circularity that becomes 84% of accumulation from a small side in the circularity distribution. The circularity of the strontium titanate particle B is obtained by image analysis of at least 300 strontium titanate particles B.

The circularity that becomes 84% of the primary particle of accumulation in the strontium titanate particles B is an index of a round shape. The circularity that becomes 84% of the primary particle of accumulation (hereinafter, referred to as circularity that becomes 84% of accumulation) is described.

FIG. 1A is an SEM image of a toner externally added with SW-360 manufactured by Titan Kogyo, Ltd., which is an example of a strontium titanate particle, and a graph of circularity distribution of the strontium titanate particle obtained by analyzing the SEM image. As shown in the SEM image, SW-360 has a main particle shape of a cubic shape, and cubic particles and spherical shapes with relatively small particle diameters are mixed. The circularity distribution of SW-360 in this example is concentrated between 0.84 and 0.92, the average circularity is 0.888, the circularity that becomes 84% of accumulation is 0.916. This is thought to reflect that: (a) the main particle shape of SW-360 is cubic shape; (b) in the projected image of the cubic particle, there are regular hexagon (circularity degree is about 0.907), flat hexagon, square (circularity degree is about 0.785), rectangle in order of being close to a circle; and (c) the strontium titanate particle having a cubic shape is adhered to the toner particle with angles and the projected image becomes mainly hexagonal.

Based on the fact that the actual circularity distribution of SW-360 is as described above and the theoretical circularity of the projected image of the cubic particle, it is estimated that the strontium titanate particle having a cubic or rectangular parallelepiped shape has a circularity that becomes 84% of primary particle of accumulation of less than 0.92.

Figure 1B:
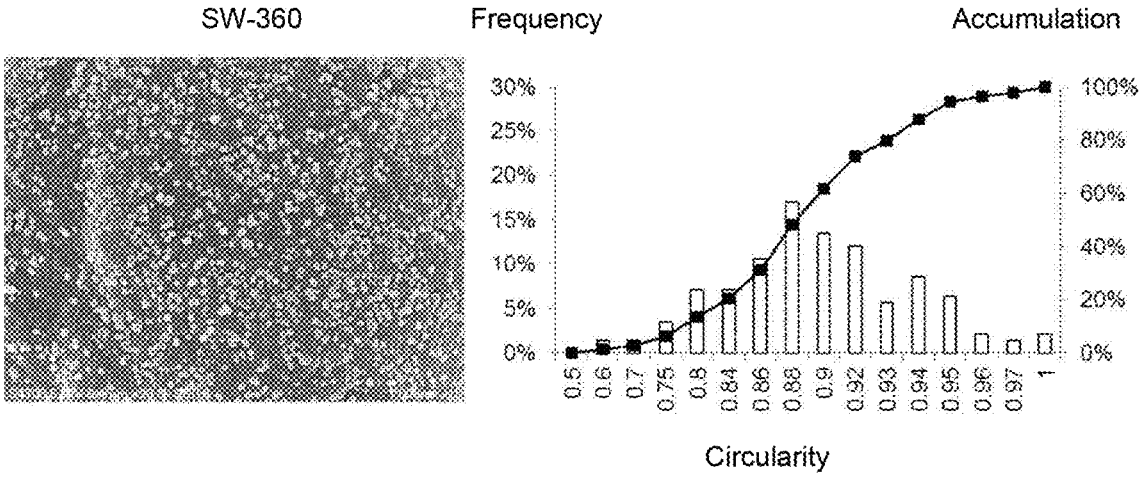
FIG. 1B is an SEM image of a toner externally added with another strontium titanate particle, and a graph of circularity distribution of the strontium titanate particle obtained by analyzing the SEM image.

On the other hand, FIG. 1B is an SEM image of a toner externally added with another strontium titanate particle, and a graph of circularity distribution of the strontium titanate particle obtained by analyzing the SEM image. As shown in the SEM image, the strontium titanate particle in this example has a round shape. The strontium titanate particle in this example has an average circularity of 0.883, and a circularity that becomes 84% of primary particle of accumulation of 0.935.

From the above, it can be said that the circularity that becomes 84% of the primary particle of accumulation in the strontium titanate particles B is an index of a round shape, and is greater than 0.92.

In the present embodiment, from the viewpoints of efficiently exerting the abrasion function on the surface of the intermediate transfer member, the strontium titanate particles B preferably have an average primary particle circularity of 0.82 to 0.94, more preferably 0.84 to 0.94, and still more preferably 0.86 to 0.92.

In the present embodiment, the strontium titanate particles B preferably has a full width at half maximum of a peak of a 110 plane obtained by the X-ray diffraction method is 0.2° to 2.0°, and more preferably 0.2° to 1.0°.

The peak of the 110 plane obtained by the X-ray diffraction method of the strontium titanate particles B is a peak appearing near the diffraction angle 20=32°. This peak corresponds to the peak of the 110 plane of the perovskite crystal.

The strontium titanate particle having a particle shape of a cubic or rectangular parallelepiped shape has high crystallinity of the perovskite crystal and the full width at half maximum of the peak of the 110 plane is usually less than 0.2°. For example, when SW-350 (strontium titanate particles having a main particle shape of a cubic shape) manufactured by Titan Kogyo, Ltd., is analyzed, the full width at half maximum of the peak of the 110 plane is 0.15.

On the other hand, the strontium titanate particles having round shapes have lower crystallinity of the perovskite crystal and the full width at half maximum of the peak of the 110 plane is wide.

In the present embodiment, it is preferable that the strontium titanate particles B have round shapes. As an index of the round shape, the full width at half maximum of the peak of the 110 plane is preferably 0.2° to 2.0°, more preferably 0.2° to 1.0°, and still more preferably 0.2° to 0.5°.

The X-ray diffraction of the strontium titanate particles is measured using an X-ray diffractometer (for example, trade name: RINT Ultima-III manufactured by Rigaku Corporation). The measurement settings are as follows: ray source: Cu Kα; voltage: 40 kV; current: 40 mA; sample rotation speed: no rotation; divergence slit: 1.00 mm; divergence vertical limit slit: 10 mm; scattering slit: open; receiving slit: open; scanning mode: FT; counting time: 2.0 seconds; step width: 0.0050°; operating axis: 10.0000° to 70.0000°. In the present disclosure, the full width at half maximum of peak in an X-ray diffraction pattern is a full width at half maximum (FWHM).

In the present embodiment, it is preferable that the strontium titanate particles B are doped with a metal element (hereinafter, also referred to as dopant) other than titanium and strontium. Since the strontium titanate particles B contain a dopant, the crystallinity of the perovskite structure is lowered to have a round shape.

The dopant for the strontium titanate particles B is not particularly limited as long as it is a metal element other than titanium and strontium. A metal element having an ionic radius that can enter the crystal structure constituting the strontium titanate particle during ionization is preferred. From this viewpoint, the dopant for the strontium titanate particles B is preferably a metal element having an ionic radius during ionization of 40 μm to 200 μm, and more preferably a metal element having an ionic radius during ionization of 60 μm to 150 μm.

Specific examples of the dopant for the strontium titanate particles B include lanthanoids, silica, aluminum, magnesium, calcium, barium, phosphorus, sulfur, calcium, vanadium, chromium, manganese, iron, cobalt, nickel, copper, gallium, yttrium, zinc, niobium, molybdenum, ruthenium, rhodium, palladium, silver, indium, tin, antimony, barium, tantalum, tungsten, rhenium, osmium, iridium, platinum, and bismuth. As the lanthanoids, lanthanum and cerium are preferred. Of these, from the viewpoint of easy doping and easy control of the shape of the strontium titanate particle, lanthanum is preferred.

As the dopant for the strontium titanate particles B, from the viewpoint of not excessively negative-charging the strontium titanate particles B, a metal element having an electronegativity of 2.0 or less is preferred, and a metal element having an electronegativity of 1.3 or less is more preferred. In the present embodiment, the electronegativity is an Allred-Rochow electronegativity. Examples of the metal element having an electronegativity of 2.0 or less include lanthanum (electronegativity of 1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), cerium (1.06), or the like.

From the viewpoint of obtaining a round shape with a perovskite crystal structure, the amount of the dopant in the strontium titanate particles B is preferably in a range of 0.1 mol % to 20 mol %, more preferably a range of 0.1 mol % to 15 mol %, and still more preferably a range of 0.1 mol % to 10 mol %.

In the present embodiment, from the viewpoint of improving the effect of the strontium titanate particles B, it is preferable that the strontium titanate particles B are strontium titanate particles having surfaces hydrophobically treated. The hydrophobically treated strontium titanate particles B repel each other on the toner particle and are highly uniformly dispersed. As a result, it is estimated that the strontium titanate particles B is easy to migrate to the intermediate transfer member while adhering to the toner particle.

In the present embodiment, it is preferable that the strontium titanate particles B are strontium titanate particles having a surface hydrophobically treated by a silicon-containing organic compound. The strontium titanate particles B which are hydrophobically treated by a silicon-containing organic compound are harder to release to a non-image part on the photoreceptor as compared with strontium titanate particles which are hydrophobically treated by a treatment agent with a strong positive charging property, such as a fatty acid metal salt, and thus the amount migrating to the intermediate transfer member is ensured.

In the present embodiment, the strontium titanate particles B preferably have a specific volume resistivity Rb (Ω·m) of 11 to 14, more preferably 11 to 13, and still more preferably 12 to 13, in terms of a common logarithm value log Rb.

The specific volume resistivity Rb of the strontium titanate particles B can be controlled, for example, according to the kind of the dopant, the amount of the dopant, the kind of the hydrophobic treatment agent, the amount of the hydrophobic treatment agent, the drying temperature and drying time after the hydrophobic treatment, or the like.

In the present embodiment, from the viewpoint of the balance between the amount of the strontium titanate particle supplied to the photoreceptor and the amount of the strontium titanate particle supplied to the intermediate transfer member, the Ra/Rb, which is a ratio of the specific volume resistivity Ra of the strontium titanate particle A to the specific volume resistivity Rb of the strontium titanate particles B, is preferably 0.35 to 0.95, more preferably 0.45 to 0.9, and still more preferably 0.55 to 0.85.

The content of the strontium titanate particles B contained in the toner according to the present embodiment is preferably 0.2 part by mass to 4.0 parts by mass, more preferably 0.2 part by mass to 3.0 parts by mass, and still more preferably 0.2 part by mass to 2.0 parts by mass, based on 100 parts by mass of the toner particle.

In the present embodiment, from the viewpoint of the balance between the amount of the strontium titanate particle supplied to the photoreceptor and the amount of the strontium titanate particle supplied to the intermediate transfer member, the Mb/Ma, which is a ratio of the content Ma of the strontium titanate particle A to the content Mb of the strontium titanate particles B, is preferably 10 to 150, more preferably 20 to 100, and still more preferably 25 to 80.

In the present embodiment, it is preferable that the strontium titanate particles B have a moisture content of 1.5 mass % to 10 mass %. When the moisture content is 1.5 mass % to 10 mass % (preferably 2 mass % to 5 mass %), the resistance of the strontium titanate particles B is controlled to an appropriate range, and suppression of uneven distribution due to electrostatic repulsion among the strontium titanate particles is excellent. The moisture content of the strontium titanate particles B can be controlled, for example, by adjusting the temperature and time of the drying treatment in producing the strontium titanate particle by a wet process. In a case where the strontium titanate particles B are hydrophobically treated, the moisture content of the strontium titanate particles B can be controlled by adjusting the temperature and time of the drying treatment after the hydrophobic treatment.

The moisture content of the strontium titanate particles B is measured as follows.

A measurement sample of 20 mg is allowed to stand and moisture-adjusted for 17 hours in a chamber having a temperature of 22° C. and a relative humidity of 55%. Thereafter, in a room having a temperature of 22° C. and a relative humidity of 55%, the measurement sample is heated from 30° C. to 250° C. at a temperature rising rate of 30° C./min in a nitrogen gas atmosphere by a thermobalance (TGA-50 type manufactured by Shimadzu Corporation). The heating loss (mass lost by heating) is measured. Based on the measured heating loss, the moisture content is calculated according to the following formula.

Moisture content (mass %)=(heating loss at 30° C. to 250° C.)/(mass before heating after moisture adjustment)×100

[Method for Producing Strontium Titanate Particle B]

The strontium titanate particles B may be a strontium titanate particle, or may be a particle in which the surface of a strontium titanate particle (sometimes referred to as base particle) is hydrophobically treated. The method for producing the strontium titanate particle (base particle) is not particularly limited, but a wet process is preferred from the viewpoint of controlling the particle diameter and shape.

Hereinafter, the method for producing the strontium titanate particle, which is the base particle of the strontium titanate particles B, is described.

The wet process for the strontium titanate particle is, for example, a method in which an alkaline aqueous solution is added to a mixed solution of a titanium oxide source and a strontium source and the two are reacted, and then the acid treatment is performed. In this production method, the particle diameter of the strontium titanate particle is controlled according to the mixing ratio of the titanium oxide source and the strontium source, the concentration of the titanium oxide source at the reaction initial stage, the temperature when adding the alkaline aqueous solution, the adding speed, or the like.

As the titanium oxide source, a mineral acid peptizer of a hydrolyzate of a titanium compound is preferred. Examples of the strontium nitrate source include strontium nitrate, strontium chloride, or the like.

The mixing ratio of the titanium oxide source and the strontium source is preferably 0.9 to 1.4, and more preferably 1.05 to 1.20, by a $SrO/TiO_2$ molar ratio. The concentration of the titanium oxide source at the reaction initial stage is preferably 0.05 mol/L to 1.3 mol/L, and more preferably 0.5 mol/L to 1.0 mol/L, as $TiO_2$.

From the viewpoint of making the shape of the strontium titanate particle not a cubic or rectangular parallelepiped shape, but a round shape, it is preferable to add a dopant source to the mixed solution of the titanium oxide source and the strontium source. Examples of the dopant source include an oxide of a metal other than titanium and strontium. The metal oxide as the dopant source is added, for example, as a solution dissolved in nitric acid, hydrochloric acid or sulfuric acid. As for the amount of the dopant source to be added, an amount causing the metal contained in the dopant source to be 0.1 mol to 20 mol is preferred, and an amount causing the metal contained in the dopant source to be 0.5 mol to 10 mol is more preferred, based on 100 mol of the strontium contained in the strontium source.

As the alkaline aqueous solution, aqueous sodium hydroxide solution is preferred. The higher the temperature of the reaction solution when adding the alkaline aqueous solution is, the better crystallinity of the obtained strontium titanate particle is. From the viewpoint of obtaining a round shape with a perovskite crystal structure, it is preferable that the temperature of the reaction solution when adding the alkaline aqueous solution is in a range of 60° C. to 100° C. As for the adding speed for the alkaline aqueous solution, the slower the adding speed is, the larger particle diameter of the obtained strontium titanate particle is; the faster the adding speed is, the smaller particle diameter of the obtained strontium titanate particle is. The addition speed of the alkaline aqueous solution is, for example, 0.001 equivalent/h to 1.2 equivalent/h, and 0.002 equivalent/h to 1.1 equivalent/h is appropriate with respect to the charged raw material.

After adding the alkaline aqueous solution, the acid treatment is performed to remove the unreacted strontium source. In the acid treatment, the pH of the reaction solution is adjusted to 2.5 to 7.0, and more preferably to 4.5 to 6.0, using hydrochloric acid for example. After the acid treatment, the reaction solution is subjected to solid-liquid separation, and the solid content is subjected to drying treatment, so as to obtain the strontium titanate particle.

Next, the surface treatment method for the strontium titanate particle (base particle) is described.

Surface treatment for the strontium titanate particle is performed by, for example, formulating a treatment solution by mixing a silicon-containing organic compound, which is a hydrophobic treatment agent, and a solvent, mixing the strontium titanate particle and the treatment solution with stirring, and continuing the stirring further. After the surface treatment, the drying treatment is performed to remove the solvent of the treatment solution.

Examples of the silicon-containing organic compound to be used in the surface treatment for the strontium titanate particle include an alkoxysilane compound, a silazane compound, silicone oil, or the like.

Examples of the alkoxysilane compound to be used in the surface treatment for the strontium titanate particle include: tetramethoxysilane, tetraethoxysilane; methyltrimethoxysilane, ethyltrimethoxysilane, propyltrimethoxysilane, butyltrimethoxysilane, hexyltrimethoxysilane, n-octyltrimethoxysilane, decyltrimethoxysilane, dodecyltrimethoxysilane, vinyltriethoxysilane, methyltriethoxysilane, ethyltriethoxysilane, butyltriethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, benzyltriethoxysilane; dimethyldimethoxysilane, dimethyldiethoxysilane, methylvinyldimethoxysilane, methylvinyldiethoxysilane, diphenyldimethoxysilane, diphenyldiethoxysilane; and trimethylmethoxysilane and trimethylethoxysilane.

Examples of the silazane compound to be used in the surface treatment for the strontium titanate particle include dimethyldisilazane, trimethyldisilazane, tetramethyldisilazane, pentamethyldisilazane, hexamethyldisilazane, or the like.

Examples of the silicone oil to be used in the surface treatment for the strontium titanate particle include: silicone oil such as dimethyl polysiloxane, diphenyl polysiloxane, and phenylmethyl polysiloxane; reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane; or the like.

As the solvent to be used in formulation of the treatment solution, in a case where the silicon-containing organic compound is an alkoxysilane compound or a silazane compound, an alcohol (for example, methanol, ethanol, propanol, and butanol) is preferred; and in a case where the silicon-containing organic compound is silicone oil, a hydrocarbon (for example, benzene, toluene, normal hexane, and n-heptane) is preferred.

In the treatment solution, the silicon-containing organic compound preferably has a concentration of 1 mass % to 50 mass %, more preferably 5 mass % to 40 mass %, and still more preferably 10 mass % to 30 mass %.

The amount of the silicon-containing organic compound to be used in surface treatment is preferably 1 part by mass to 50 parts by mass, more preferably 5 parts by mass to 40 parts by mass, and still more preferably 5 parts by mass to 30 parts by mass, based on 100 parts by mass of the strontium titanate particle.

[Toner Particle]

The toner particle contains, for example, a binder resin, a colorant, a releasing agent, and other additives as needed.

—Binder Resin—

Examples of the binder resin include: a homopolymer of a monomer such as styrenes (for example, styrene, parachlorostyrene, α-methylstyrene, etc.), (meth)acrylate esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.), ethylenically unsaturated nitriles (for example, acrylonitrile, methacrylonitrile, etc.), vinyl ethers (for example, vinyl methyl ether, vinyl isobutyl ether, etc.), vinyl ketones (for example, vinyl methyl ketone, vinyl ethyl ketone, vinyl isopropenyl ketone, etc.), and olefins (for example, ethylene, propylene, butadiene, etc.); or a vinyl resin made of a copolymer obtained by combining two or more kinds of these monomers.

Examples of the binder resin also include: non-vinyl resins such as epoxy resin, polyester resin, polyurethane resin, polyamide resin, cellulose resin, polyether resin, and modified rosin; a mixture of these and the vinyl resin; or a graft polymer obtained by polymerizing a vinyl monomer under coexistence of these.

The above binder resins may be used alone, or may be used in combination of two or more thereof.

As the binder resin, the polyester resin is suitable. Examples of the polyester resin include a polycondensate of a polyvalent carboxylic acid and a polyhydric alcohol.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, sebacic acid, etc.), alicyclic dicarboxylic acids (such as cyclohexanedicarboxylic acid, etc.), aromatic dicarboxylic acids (for example, terephthalic acid, isophthalic acid, phthalic acid, naphthalenedicarboxylic acid, etc.), and anhydrides thereof or lower (e.g., having 1 to 5 carbon atoms) alkyl esters thereof. Of these, as the polyvalent carboxylic acid, for example, the aromatic dicarboxylic acids are preferred.

As the polyvalent carboxylic acid, a trivalent or higher carboxylic acid having a crosslinked structure or a branched structure may be used together with the dicarboxylic acid. Examples of the trivalent or higher carboxylic acid include trimellitic acid, pyromellitic acid, anhydrides thereof, lower (e.g., having 1 to 5 carbon atoms) alkyl esters thereof, or the like.

The above polyvalent carboxylic acids may be used alone, or may be used in combination of two or more thereof.

Examples of the polyhydric alcohol include aliphatic diols (for example, ethylene glycol, diethylene glycol, triethylene glycol, propylene glycol, butanediol, hexanediol, neopentyl glycol, etc.), alicyclic diols (for example, cyclohexanedio cyclohexanedimethanol, hydrogenated bisphenol A, etc.), and aromatic diols (for example, an ethylene oxide adduct of bisphenol A, a propylene oxide adduct of bisphenol A, etc.). Of these, as the polyhydric alcohol, for example, the aromatic diols and alicyclic diols are preferred, and the aromatic diols are more preferred.

As the polyhydric alcohol, a trihydric or higher polyhydric alcohol having a crosslinked structure or a branched structure may be used together with the diol. Examples of the trihydric or higher polyhydric alcohol include glycerin, trimethylolpropane, and pentaerythritol.

The above polyhydric alcohols may be used alone, or may be used in combination of two or more thereof.

The polyester resin preferably has a glass transition temperature (Tg) of 50° C. to 80° C., more preferably 50° C. to 65° C.

The glass transition temperature is obtained from a DSC curve obtained by differential scanning calorimetry (DSC). More specifically, the glass transition temperature can be obtained from "extrapolated glass transition starting temperature" described in JIS K 7121-1987 "Method for measuring plastic transition temperature" for determining the glass transition temperature.

The polyester resin preferably has a weight average molecular weight of 5,000 to 1,000,000, and more preferably from 7,000 to 500,000. The polyester resin preferably has a number average molecular weight (Mn) of 2,000 to 100,000. The polyester resin preferably has a molecular weight distribution Mw/Mn of 1.5 to 100, and more preferably 2 to 60.

The weight average molecular weight and the number average molecular weight of the polyester resin are measured by gel permeation chromatography (GPC). The measurement of the molecular weight by GPC is performed with THF solvent using GPC-HLC-8120 GPC manufactured by Tosoh Corporation as a measuring apparatus, and using a Column TSK gel Super HM-M (15 cm) manufactured by Tosoh Corporation. The weight average molecular weight and the number average molecular weight are calculated from this measurement result using a molecular weight calibration curve prepared from a monodisperse polystyrene standard sample.

The polyester resin can be obtained by known production methods. Specifically, the polyester resin can be obtained by, for example, a method in which the polymerization temperature is set to 180° C. to 230° C., and if necessary, the inside of the reaction system is depressurized, and the reaction is performed while removing water and alcohol generated during the condensation.

In a case where the raw material monomers are not dissolved or incompatible with each other at the reaction temperature, a solvent having a high boiling point may be added as a dissolution aid and dissolved. In this case, the polycondensation reaction is performed while the distilling off the dissolution aid. In a case where a monomer having poor compatibility are present, it is preferable to previously condensate the monomer having poor compatibility with an acid or an alcohol to be polycondensed with the monomer, and to polycondensate the above with a main component.

The content of the binder resin is preferably 40 mass % to 95 mass %, more preferably 50 mass % to 90 mass %, and still more preferably 60 mass % to 85 mass %, based on all toner particles.

—Colorant—

Examples of the colorant include: pigments such as carbon black, chrome yellow, hansa yellow, benzidine yellow, threne yellow, quinoline yellow, pigment yellow, permanent orange GTR, pyrazolone orange, vulcan orange, watch young red, permanent red, brilliant carmine 3b, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine type, xanthene type, azo type, benzoquinone type, azine type, anthraquinone type, thioindigo type, dioxazine type, thiazine type, azomethine type, indigo type, phthalocyanine type, aniline black type, polymethine type, triphenylmethane type, diphenylmethane type, and thiazole type.

The colorant may be used alone, or may be used in combination of two or more thereof.

As the colorant, if necessary, a surface-treated colorant may be used or a dispersant may be used in combination. In addition, a plurality of colorants may be used in combination.

The content of the colorant is preferably 1 mass % to 30 mass %, and more preferably 3 mass % to 15 mass %, based on all toner particles.

—Releasing Agent—

Examples of the releasing agent include: hydrocarbon waxes; natural waxes such as a carnauba wax, a rice wax, and a candelilla wax; synthetic or mineral/petroleum waxes such as a montan wax; ester waxes such as a fatty acid ester and a montanic acid ester; or the like. The releasing agent is not limited thereto.

The melting point of the releasing agent is preferably 50° C. to 110° C., and more preferably 60° C. to 100° C.

The melting temperature is obtained by the "melting peak temperature" described in the method of obtaining the melting temperature of JIS K 7121-1987 "Method for Measuring Transition Temperature of Plastics", from a DSC curve obtained by differential scanning calorimetry (DSC).

The content of the releasing agent is preferably 1 mass % to 20 mass %, and more preferably 5 mass % to 15 mass %, based on all toner particles.

—Other Additives—

Examples of other additives include known additives such as a magnetic material, a charge control agent, and an inorganic powder. These additives are contained in the toner particle as internal additives.

[Properties of Toner Particle]

The toner particle may be toner particles having a single-layer structure, or may be toner particles having a so-called core-shell structure of a core portion (core particle) and a coating layer (shell layer) coating the core portion. The toner particle having a core-shell structure includes, for example, a core portion containing a binder resin and if necessary, a colorant and a releasing agent, and a covering layer containing a binder resin.

The volume average particle diameter (D50v) of the toner particle is preferably 2 μm to 10 μm, and more preferably 4 μm to 8 μm.

The volume average particle diameter of the toner particle is measured using Coulter Multisizer II (manufactured by Beckman Coulter, Inc.) and using an electrolyte of ISOTON-II (manufactured by Beckman Coulter, Inc.). During measurement, as a dispersant, 0.5 mg to 50 mg of a measurement sample is added to 2 ml of a 5 mass % aqueous solution of a surfactant (sodium alkylbenzenesulfonate is preferred). The above is added to 100 ml to 150 ml of an electrolytic solution. The electrolytic solution suspended with the sample is subjected to dispersion treatment in an ultrasonic disperser for 1 minute, and particle diameters of particles having a particle diameter range of 2 μm to 60 μm is measured using an aperture having an aperture diameter of 100 μm by Coulter Multisizer II. The number of the particles as samples is 50,000. In the volume-based particle diameter distribution of the measured particle diameters, a particle diameter that becomes 50% of accumulation from a small diameter side is taken as the volume average particle diameter D50v.

The average circularity of the toner particle is preferably 0.94 to 1.00, and more preferably 0.95 to 0.98.

The average circularity of the toner particle is obtained by (circle-equivalent perimeter)/(perimeter) [(perimeter of circle having same projected area as particle image)/(perimeter of projected particle image)]. Specifically, the average circularity of the toner particle is a value measured by the following method.

First, the toner particles to be measured are sucked and collected to form a flat flow, flash light is instantaneously emitted, a particle image is thus captured as a still image, and the particle image is analyzed by a flow type particle image analyzer (FPIA-3000 manufactured by Sysmex Corporation). Then, the sampling number when obtaining the average circularity is set to 3,500. In a case where an external additive is contained in the toner, the toner (developer) to be measured is dispersed in water containing a surfactant, and thereafter, the ultrasonic treatment is performed to obtain the toner particle from which the external additive has been removed.

[External Additive]

The toner according to the present embodiment may contain other external additives other than the strontium titanate particle within a range that can provide the effect of the present embodiment. Examples of the other external additives include the following inorganic particle and resin particle.

Examples of the other external additives include an inorganic particle. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, or the like.

It is preferable to subject the surface of the inorganic particle as an external additive to hydrophobic treatment. The hydrophobic treatment is performed by immersing the inorganic particle into a hydrophobic treatment agent, for example. The hydrophobic treatment agent is not particularly limited, and examples include a silane-based coupling agent, silicone oil, a titanate coupling agent, an aluminum coupling agent, or the like. The hydrophobic treatment agent may be used alone, or may be used in combination of two or more thereof.

The amount of the hydrophobic treatment agent is usually 1 part by mass to 10 parts by mass based on 100 parts by mass of the inorganic particle.

Examples of the other external additives also include a resin particle (a resin particle such as polystyrene, polymethyl methacrylate, and a melamine resin), a cleaning active agent (for example, a particle of a fluorine polymer), or the like.

The content of the other external additives is preferably 0.01 mass % to 5 mass %, and more preferably 0.01 mass % to 2.0 mass %, based on all toner particles.

[Method for Producing Toner]

Next, a method for producing the toner according to the present embodiment is described.

The toner particle according to the present embodiment can be obtained by externally adding an external additive to the toner particle after producing the toner particle.

The toner particle may be produced by either a dry process (e.g., a kneading and grinding method), or a wet process (e.g., an aggregation and coalescence method, a suspension polymerization method, and a dissolution suspension method). It is not particularly limited to the above production methods, and known methods can be adopted. Of these, it is preferable to obtain the toner particle by an aggregation and coalescence method.

Specifically, for example, in a case where the toner particle is produced by an aggregation and coalescence method, the production method includes:

a step of preparing a resin particle dispersion solution in which resin particles as a binder resin are dispersed (a resin particle dispersion solution preparation step); a step of aggregating the resin particle (if necessary, other particles) in the resin particle dispersion solution (if necessary, in a dispersion solution mixed with other particle dispersion solutions) to form an aggregated particle (an aggregated particle formation step); and a step of heating an aggregated particle dispersion solution in which aggregated particles are dispersed, and melting and uniting the aggregated particles to form the toner particle (a melting and uniting step).

Hereinafter, each step is described in detail.

In the following description, although a method for obtaining toner particles containing a colorant and a releasing agent is described, the colorant and the releasing agent are used as needed. Of course, other additives other than the colorant and the releasing agent may also be used.

—Resin Particle Dispersion Solution Preparation Step—

Together with the resin particle dispersion solution in which resin particles as a binder resin are dispersed, for example, a colorant particle dispersion solution in which colorant particles are dispersed, and a releasing agent particle dispersion solution in which releasing agent particles are dispersed are prepared.

The resin particle dispersion solution is formulated, for example, by dispersing resin particles in a dispersion medium with a surfactant.

Examples of the dispersion medium to be used in the resin particle dispersion solution include an aqueous medium.

Examples of the aqueous medium include water such as distilled water and ion exchanged water, and alcohols. The dispersion medium may be used alone, or may be used in combination of two or more thereof.

Examples of the surfactant include: anionic surfactants such as a sulfate ester salt type, a sulfonate type, phosphoric acid ester type, and a soap type; cationic surfactants such as amine salt type and quaternary ammonium salt type; nonionic surfactants such as polyethylene glycol type, alkylphenol ethylene oxide adduct type, and polyhydric alcohol type; or the like. Of these, the anionic surfactants and the cationic surfactants are particularly preferred. The nonionic surfactants may be used in combination with the anionic surfactants or the cationic surfactants.

The surfactant may be used alone, or may be used in combination of two or more thereof.

Examples of a method for dispersing the resin particles into the dispersion medium in the resin particle dispersion solution include common dispersion methods such as a rotary shearing type homogenizer, a ball mill having a medium, a sand mill, and a Dyno-mill. Depending on the kind of the resin particles, the resin particles may be dispersed into the dispersion medium by a phase inversion emulsification method. The phase inversion emulsification method is a method in which a resin to be dispersed is dissolved in a hydrophobic organic solvent in which the resin is soluble, a base is added to an organic continuous phase (O phase) for neutralization, then an aqueous medium (W phase) is charged thereto, and thereby phase inversion from W/O to O/W is performed to disperse the resin in the form of particles into the aqueous medium.

The resin particle to be dispersed in the resin particle dispersion solution preferably has a volume average particle diameter of 0.01 μm to 1 μm, more preferably 0.08 μm to 0.8 μm, and still more preferably 0.1 μm to 0.6 μm.

The volume average particle diameter of the resin particle is measured by: using a particle size distribution obtained by measurement with a laser diffraction type particle size distribution measuring device (for example, LA-700, manufactured by Horiba, Ltd.), subtracting the accumulated distribution from the small particle diameter side for the volume with respect to the divided particle size range (channel), and taking a particle diameter that becomes 50% of accumulation with respect to the whole particles as the volume average particle diameter D50v. The volume average particle diameter of the particles in other dispersion solutions is measured in the same manner The content of the resin particle contained in the resin particle dispersion solution is preferably 5 mass % to 50 mass %, and more preferably 10 mass % to 40 mass %.

For example, the colorant particle dispersion solution and the releasing agent particle dispersion solution are formulated in the same manner as the resin particle dispersion solution. That is, as for the volume average particle diameter of the particle, the dispersion medium, the dispersion method and the content of the particle in the resin particle dispersion solution, the same applies to the colorant particles dispersed in the colorant particle dispersion solution and the releasing agent particles dispersed in the releasing agent particle dispersion solution.

—Aggregated Particle Formation Step—

Next, the resin particle dispersion solution, the colorant particle dispersion solution, and the releasing aunt particle dispersion solution are mixed. Then, in the mixed dispersion solution, an aggregated particle is formed, which contains the resin particles, the colorant particles and the releasing agent particles, and has a diameter approximate to the diameter of the toner particle for hetero-aggregating the resin particles, the colorant particles and the releasing agent particles.

Specifically, for example, an agglomerator is added to the mixed dispersion solution, pH of the mixed dispersion solution is adjusted to be acidic (e.g., pH of 2 to 5), and if necessary, a dispersion stabilizer is added thereto. Thereafter, the mixed dispersion solution is heated to a temperature approximate to the glass transition temperature of the resin particle (e.g., the glass transition temperature of the resin particle—30° C. to the glass transition temperature of the resin particle—10° C.), and the particles dispersed in the mixed dispersion solution are aggregated to form the aggregated particle.

The aggregated particle formation step may be performed by, for example, stirring the mixed dispersion solution by a rotary shearing type homogenizer, adding an agglomerator thereto at room temperature (e.g., 25° C.), adjusting the pH of the mixed dispersion solution to be acidic (e.g., pH of 2 to 5), if necessary, adding a dispersion stabilizer thereto, and thereafter, performing heating.

Examples of the agglomerator include a surfactant having different polarity from the surfactant contained in the mixed dispersion solution, an inorganic metal salt, and a divalent or higher valent metal complex. In a case where a metal complex is used as the agglomerator, the amount of the surfactant used is reduced, and the charging property is improved.

Together with the agglomerator, an additive for forming a complex or similar bond with the metal ion of the agglomerator may also be used, if necessary. As this additive, a chelating agent is suitably used.

Examples of the inorganic metal salt include: metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide; or the like.

As the chelating agent, as soluble chelating agent may also be used. Examples of the chelating agent include: oxycarboxylic acid such as tartaric acid, citric acid, and gluconic acid; amino carboxylic acids such as iminodiacetic acid (IDA), nitrilotriacetic acid (NTA), and ethylenediamine tetraacetic acid (EDTA); or the like.

The amount of the chelating agent to be added is preferably 0.01 part by mass to 5.0 parts by mass, and more preferably 0.1 part by mass or more to less than 3.0 parts by mass, based on 100 parts by mass of the resin particle.

—Melting and Uniting Step—

Subsequently, the aggregated particle dispersion solution in which aggregated particles are dispersed is heated to, for example, a temperature equal to or higher than the glass transition temperature of the resin particle (e.g., a temperature equal to or 10° C. to 30° C. higher than the glass transition temperature of the resin particle), and the aggregated particles are melt and united to form the toner particle.

After the above steps, the toner particle can be obtained.

The toner particle may also be produced by: a step of forming a second aggregated particle after obtaining the aggregated particle dispersion solution in which aggregated particles are dispersed, by further mixing the aggregated particle dispersion solution and the resin particle dispersion solution in which the resin particles are dispersed, and aggregating the resin particles to further adhere the resin particles onto the surface of the aggregated particles; and a step of forming toner particles having a core-shell structure by heating a second aggregated particle dispersion solution in which second aggregated particles are dispersed, and melting and uniting the second aggregated particles.

After completion of the melting and uniting step, a known washing step, solid-liquid separation step and drying step are applied to the toner particle formed in the solution, so as to obtain a dried toner particle. From the viewpoint of charging property, it is preferable to apply substitution washing with ion exchanged water sufficiently in the washing step. From the viewpoint of productivity, it is preferable to apply suction filtration, pressure filtration or the like in the solid-liquid separation step. From the viewpoint of productivity, it is preferable to apply freeze drying, air flow drying, fluid drying, vibration fluid drying or the like in the drying step.

The toner particle according to the present embodiment is produced by, for example, adding an external additive to the obtained dried toner particle and mixing the above. It is preferable that the mixing is performed by, for example, a V blender, a Henschel mixer, a Lodige mixer or the like. Further, if necessary, coarse particles of the toner may be removed using an ultrasonic vibrating sieve, an air sieve or the like.

<Electrostatic Charge Image Developer>

The electrostatic charge image developer according to the present embodiment at least contains the toner according to the present embodiment.

The electrostatic charge image developer according to the present embodiment may be a one-component developer containing only the toner according to the present embodiment, or may be a two-component developer with the toner and a carrier mixed.

The carrier is not particularly limited and examples thereof include known carriers. Examples of the carrier include: a coated carrier, in which a resin is coated on the surface of a core material made of magnetic powders; a magnetic powder dispersed carrier, in which magnetic powders are dispersed in a matrix resin; a resin-impregnated carrier, in which porous magnetic powders are impregnated with a resin; or the like. The magnetic powder dispersed carrier and the resin-impregnated carrier may be a carrier in which constituent particles of the carrier are used as a core material and the surface is coated with a resin.

Examples of the magnetic powder include: magnetic metals such as iron, nickel and cobalt; magnetic oxides such as ferrite and magnetite; or the like.

Examples of the coating resin and the matrix resin include: polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin containing an organosiloxane bond or a modified product thereof, fluororesin, polyester, polycarbonate, phenolic resin, epoxy resin, or the like. The coating resin and the matrix resin may contain a conductive particle, or other additives. Examples of the conductive particle include: particles of metals such as gold, silver, and copper, and particles of carbon black, titanium oxide, zinc oxide, tin oxide, barium sulfate, aluminum borate, and potassium titanate.

To coat the surface of the core material with a resin, the method includes a method in which the coating resin and various additives (which are used if necessary) are dissolved in a suitable solvent to form a coating layer forming solution, and then the solution is coated. The solvent is not particularly limited, and may be selected considering the type of the resin to be used, coating suitability, or the like.

Specific examples of the method for coating a resin include: an immersion method for immersing a core material in a coating layer forming solution; a spray method for spraying a coating layer forming solution on to the surface of a core material; a fluidized bed method for spraying a coating layer forming solution in a state where a core material is suspended by flowing air; a kneader coater method for mixing a core material of a carrier and a coating layer forming solution on a kneader coater and thereafter removing the solvent; or the like.

In the two-component developer, the mixing ratio (mass ratio) of the toner and the carrier (toner: carrier) is preferably 1:100 to 30:100, and more preferably 3:100 to 20:100.

<Image Forming Apparatus and Image Forming Method>

The image forming apparatus and the image forming method according to the present embodiment are described.

The image forming apparatus according to the present embodiment includes: an image holder; a charging unit, which charges a surface of the image holder; an electrostatic charge image forming unit, which forms an electrostatic charge image on the surface of the charged image holder; a developing unit, which houses an electrostatic charge image developer, and develops the electrostatic charge image formed on the surface of the image holder as a toner image by the electrostatic charge image developer; an intermediate transfer member, which transfers the toner image formed on the surface of the image holder; a primary transfer unit, which transfers the toner image formed on a surface of the intermediate transfer member onto the surface of the image holder; a secondary transfer unit, which transfers the toner image formed on the surface of the intermediate transfer member onto a surface of a record medium; and a fixing unit, which fixes the transferred toner image onto the surface of the record medium. The electrostatic charge image developer according to the present embodiment is applied as the electrostatic charge image developer.

In the image forming apparatus according to the present embodiment, an image forming method (the image forming method according to the present embodiment) is implemented, which includes: a charging step of charging a surface of an image holder; an electrostatic charge image forming step of forming an electrostatic charge image on the surface of the charged image holder; a developing step of developing the electrostatic charge image formed on the surface of the image holder as a toner image by the electrostatic charge image developer according to the present embodiment; a primary transfer step of transferring the toner image formed on a surface of the intermediate transfer member onto the surface of the image holder; a second transfer step of transferring the toner image formed on the surface of the intermediate transfer member onto a surface of a record medium; and a fixing step of fixing the transferred toner image onto the surface of the record medium.

In the image forming apparatus according to the present embodiment, known image forming apparatuses are applicable, including: an apparatus including cleaning unit for cleaning the surface of the charged image holder after the primary transferring; an apparatus including a discharge unit for discharging by irradiating discharging light onto the surface of the image holder before charging, after the primary transferring; and an apparatus including a cleaning unit for cleaning the surface of the intermediate transfer member after the second transferring.

In the image forming apparatus according to the present embodiment, for example, a portion including the developing unit may be a cartridge structure (process cartridge) detachably attached to the image forming apparatus. As the process cartridge, for example, a process cartridge for housing the electrostatic charge image developer according to the present embodiment and including a developing unit is suitably used.

Hereinafter, an example of the image forming apparatus according to the present embodiment is shown, but the present disclosure is not limited thereto. In the following description, the main part shown in the figure is explained, and the explanation of the other parts is omitted.

Figure 2:
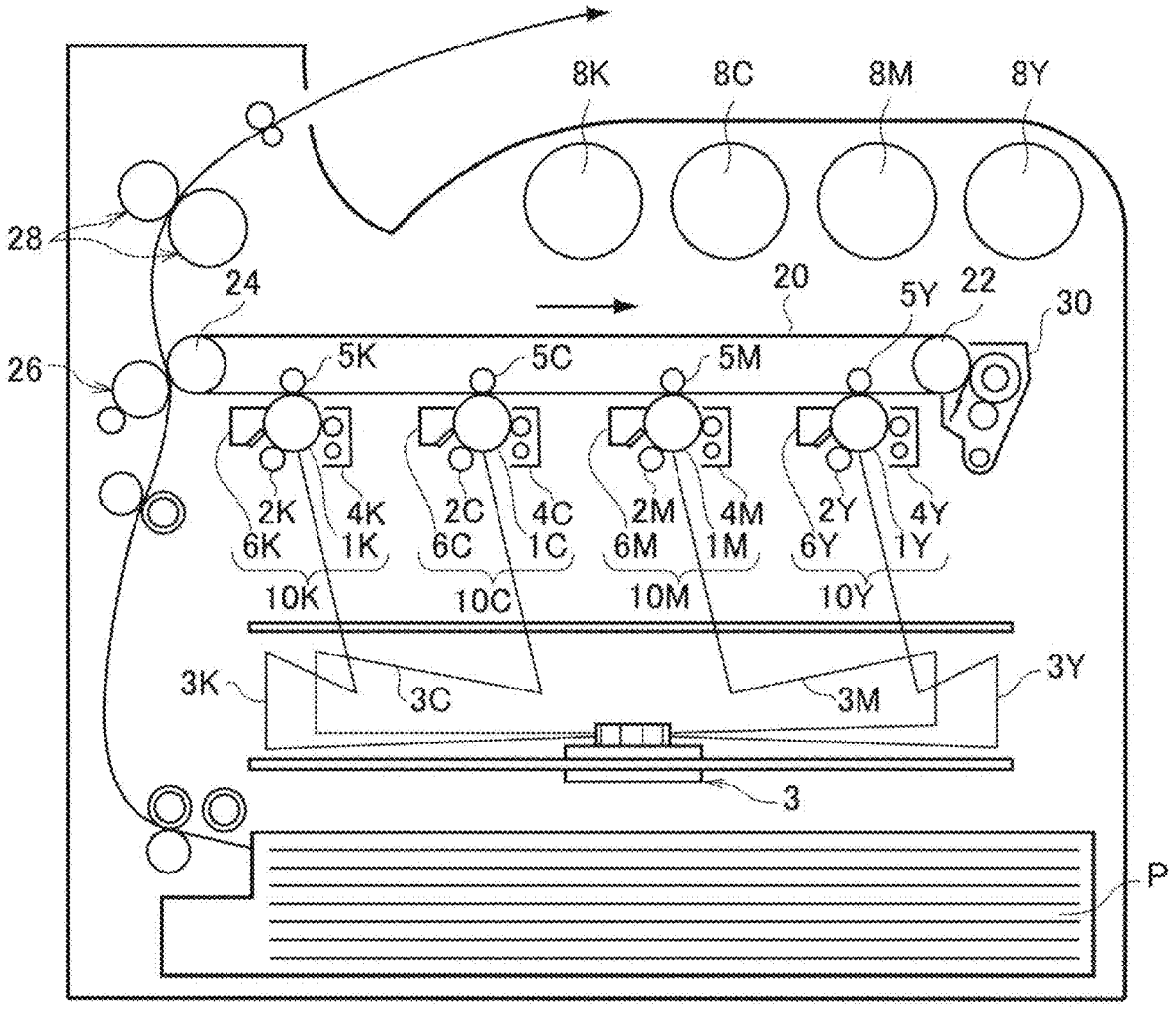
FIG. 2 is a schematic configuration diagram showing an example of an image forming apparatus according to the present embodiment.

FIG. 2 is a schematic configuration diagram showing the image forming apparatus according to the present embodiment.

The image forming apparatus shown in FIG. 2 includes first to fourth electrophotographic image forming units 10Y, 10M, 10C, and 10K (image forming units) for outputting images of respective colors of yellow (Y), magenta (M), cyan (C), and black (K) based on color-separated image data. These image forming units (hereinafter sometimes simply referred to as "units") 10Y, 10M, 10C, and 10K are provided horizontally at predetermined distances apart from each other. The units 10Y, 10M, 10C, and 10K may be a process cartridge detachably attached to the image forming apparatus.

Above the units 10Y, 10M, 10C, and 10K, an intermediate transfer belt (an example of the intermediate transfer member) 20 is provided extending though the units. The intermediate transfer belt 20 is wound around a drive roll 22 and a support roll 24 and is configured to run in a direction from the first unit 10Y to the fourth unit 10K. A force is applied to the support roll 24 in a direction away from the drive roll 22 by a spring or the like (not shown), and a tension is applied to the intermediate transfer belt 20 winding around the above two rolls. On an image holder side surface of the intermediate transfer belt 20, an intermediate transfer member cleaning device 30 is provided facing the drive roll 22.

The intermediate transfer belt 20 is, for example, a laminate having a substrate layer and a surface layer disposed on an outer peripheral surface of the substrate layer. The substrate layer contains, for example, a resin such as polyimide resin, polyamide resin, polyamide imide resin, polyether ester resin, polyarylate resin and polyester resin, and a conductive agent. The surface layer contains, for example, at least one resin of the above resins, fluororesin, and a conductive agent. The intermediate transfer belt 20 has a thickness of, for example, 50 μm to 100 μm.

Developing devices (an example of the developing unit) 4Y, 4M, 4C, and 4K of the units 10Y, 10M, 10C, and 10K are supplied with toners of yellow, magenta, cyan and black housed in toner cartridges 8Y, 8M, 8C, and 8K, respectively.

Since the first to fourth units 10Y 10M, 10C, and 10K have the same configuration and operation, herein description will be made with respect to the first unit 10Y forming a yellow image disposed on an upstream side in a running direction of the intermediate transfer belt.

The first unit 10Y includes a photoreceptor 1Y functioning as an image holder. Around the photoreceptor 1Y, the followings are disposed in order: a charging roll (an example of the charging unit) 2Y for charging the surface of the photoreceptor 1Y to a predetermined potential; an exposure device (an example of the electrostatic charge image forming unit) 3 for forming an electrostatic charge image by exposing the charged surface with a laser beam 3Y based on a color-separated image signal; a developing device (an example of the developing unit) 4Y for developing the electrostatic charge image by supplying the charged toner to the electrostatic charge image; a primary transfer roll 5Y (an example of the primary transfer unit) for transferring the developed toner image onto the intermediate transfer belt 20; and a photoreceptor cleaning device (an example of the cleaning unit) 6Y for removing the toner remaining on the surface of the photoreceptor 1Y after the primary transfer.

The primary transfer roll 5Y is disposed on an inner side of the intermediate transfer belt 20 and is provided at a position facing the photoreceptor 1Y. Bias power supplies (not shown) for applying a primary transfer bias are connected to the primary transfer rolls 5Y, 5M, 5C, and 5K of the units, respectively. Each bias power supply changes the value of the transfer bias to be applied to each primary transfer roll under the control of a control unit (not shown).

The photoreceptor cleaning device 6Y includes a cleaning blade in contact with the surface of the photoreceptor 1Y. The cleaning blade comes into contact with the surface of the photoconductor 1Y which continues rotating even after the toner image is transferred onto the intermediate transfer belt 20, and thereby removes the toner remaining on the surface of the photoreceptor 1Y.

On a downstream of the fourth unit 10K, a secondary transfer roll (an example of the secondary transfer unit) 26 and the support roll 24 is provided. The secondary transfer roll 26 is disposed in an image holding surface side of the intermediate transfer belt 20. The support roll 24 is disposed to be contact with an inner surface of the intermediate transfer belt 20. Therefore, the secondary transfer roll 26 and the support roll 24 configure a secondary transfer portion.

The intermediate transfer member cleaning device 30 includes a cleaning blade in contact with the surface of the intermediate transfer belt 20. The cleaning blade comes into contact with the surface of the intermediate transfer belt 20 which continues running even after the toner image is transferred onto the record medium, and thereby removes the toner remaining on the surface of the intermediate transfer belt 20. Examples for the cleaning blade include thermosetting polyurethane rubber, silicone rubber, fluorine rubber, ethylene-propylene-diene rubber, or the like. The cleaning blade has a thickness of 1 mm to 7 mm, for example.

Hereinafter, the operation for forming a yellow image on the first unit 10Y is described.

First, before the operation, the surface of the photoreceptor 1Y is charged with a potential of 600 V to 800 V by the charging roll 2Y.

The photoreceptor 1Y is formed by laminating a photosensitive layer on a conductive (e.g., having a volume resistivity of $1\times10^{-6}$ Ωcm at 20° C.) substrate. This photosensitive layer is usually highly resistant (resistance of general resins). However, when the photosensitive layer is irradiated by a laser beam, the portion irradiated by the laser beam has a property of changed resistivity. Then, the laser beam 3Y is irradiated from the exposure device 3 to the surface of the charged photoreceptor 1Y, according to the image data for yellow sent from a control unit (not shown). Accordingly, an electrostatic charge image having a yellow image pattern is formed on the surface of the photoreceptor 1Y.

The electrostatic charge image is an image formed on the surface of the photoreceptor 1Y by charging, and is a so-called negative latent image, in which the resistivity of the portion of the photosensitive layer irradiated with the laser beam 3Y is lowered, and the charges on the surface of the photoreceptor 1Y flows, and which is formed by the residual charge of the portion not irradiated with the laser beam 3Y.

The electrostatic charge image formed on the photoreceptor 1Y rotates to a predetermined developing position as the photoreceptor 1Y runs. Then, at this developing position, the electrostatic charge image on the photoreceptor 1Y is developed and visualized as a toner image by the developing device 4Y.

The developing device 4Y houses, for example, an electrostatic charge image developer containing at least a yellow toner and a carrier. The yellow toner is triboelectrically charged by performing stirring in the developing device 4Y, and has charges having polarity (negative polarity) same as the charges on the photoreceptor 1Y, thereby being held on a developer roll (an example of the developer holder). Then, as the surface of the photoreceptor 1Y passes through the developing device 4Y, the yellow toner electrostatically adheres to a discharged latent image portion on the surface of the photoreceptor 1Y, and thus the latent image is developed by the yellow toner. The photoreceptor 1Y on which a yellow toner image is formed continues running at a predetermined speed, and the toner image developed on the photoreceptor 1Y is conveyed to a predetermined primary transfer position.

When the yellow toner image on the photoreceptor 1Y is conveyed to the primary transfer position, a primary transfer bias is applied to the primary transfer roll 5Y, an electrostatic force acts on the toner image from the photoreceptor 1Y to the primary transfer roll 5Y, and thus the toner image on the photoreceptor 1Y is transferred onto the intermediate transfer belt 20. At this time, the applied transfer bias has a polarity (+) opposite to the polarity (−) of the toner and is controlled to be +10 μA, for example, by a control unit (not shown) in the first unit 10Y.

The photoreceptor 1Y continues rotating after the toner image is transferred onto the intermediate transfer belt 20, and contacts with the cleaning blade including in the photoreceptor cleaning device 6Y. The toner remaining on the photoreceptor 1Y is removed and recovered by the photoreceptor cleaning device 6Y.

The primary transfer bias applied to the primary transfer rolls 5M, 5C, and 5K after the second unit 10M is also controlled in accordance with the first unit.

In this way, the intermediate transfer belt 20 onto which the yellow toner image is transferred in the first unit 10Y is sequentially conveyed through the second to fourth units 10M, 10C, and 10K, and toner images of respective colors are superimposed and transferred multiply.

The intermediate transfer belt 20 onto which four color toner images are multiply transferred through the first to fourth units reaches the secondary transfer portion configured by the intermediate transfer belt 20, the support roll 24 in contact with the intermediate transfer belt, the secondary transfer roll (an example of the secondary transfer unit) 26 disposed on the image holding surface side of the intermediate transfer belt 20. On the other hand, a recording paper (an example of the record medium) P is fed at a predetermined timing to a gap between the secondary transfer roll 26 and the intermediate transfer belt 20 via a supply mechanism, and a secondary transfer bias is applied to the support roll 24 At this time, the applied transfer bias has a polarity (−) same as the polarity (−) of the toner, an electrostatic force acts on the toner image from the intermediate transfer belt 20 to the recording paper P, and thus the toner image on the intermediate transfer belt 20 is transferred onto the recording paper P. The secondary transfer bias at this time is determined based on the resistance detected by a resistance detecting unit (not shown) for detecting the resistance of the secondary transfer portion, and the voltage is controlled.

The intermediate transfer belt 20 continues rotating after the toner image is transferred onto the recording paper P, and contacts with the cleaning blade including in the intermediate transfer member cleaning device 30. The toner remaining on the intermediate transfer belt 20 is removed and recovered by the intermediate transfer member cleaning device 30. The cleaning blade has a contact pressure (pressured applied on a thickness direction of the intermediate transfer belt 20) is 1 g/mm to 5 g/mm, for example. The cleaning blade has a contact angle of 5 degrees to 30 degrees, for example. The cleaning blade has a contact width of 0.1 mm to 2 mm, for example.

The recording paper P onto which the toner image is transferred is fed into a pressure contact portion (nip portion) of a pair of fixing rollers in the fixing device (an example of the fixing unit) 28, the toner image is fixed onto the recording paper P, and thus a fixed image is formed.

Examples of the recording paper P onto which the toner image is transferred include a plain paper used in an electrophotographic copier, a printer, or the like. Examples of the record medium include an OHP sheet or the like, in addition to the recording paper P. In order to further improve the smoothness of the surface of the fixed image, it is preferable that the surface of the recording paper P is also smooth. For example, a coated paper obtained by coating the surface of plain paper with a resin, art paper for printing or the like is preferably used.

The recording paper P onto which the fixing of the color image is completed is carried out toward a discharging portion, and a series of color image forming operations are ended.

<Process Cartridge and Toner Cartridge>

The process cartridge according to the present embodiment is described.

The process cartridge according to the present embodiment is a process cartridge including: a developing unit which houses the electrostatic charge image developer according to the present embodiment, and develops the electrostatic charge image formed on the surface of the image holder by the electrostatic charge image developer; and an intermediate transfer member which transfers the toner image formed on the surface of the image holder, and the process cartridge is detachably attached to the image forming apparatus.

The process cartridge according to the present embodiment is not limited to the above configuration, and may include a developing unit and at least one selected from other units, for example, an image holder, a charging unit, an electrostatic charge image forming unit and a transfer unit, if necessary.

Hereinafter, an example of the process cartridge according to the present embodiment is shown, but the present disclosure is not limited thereto. In the following description, the main part shown in the figure is explained, and the explanation of the other parts is omitted.

Figure 3:
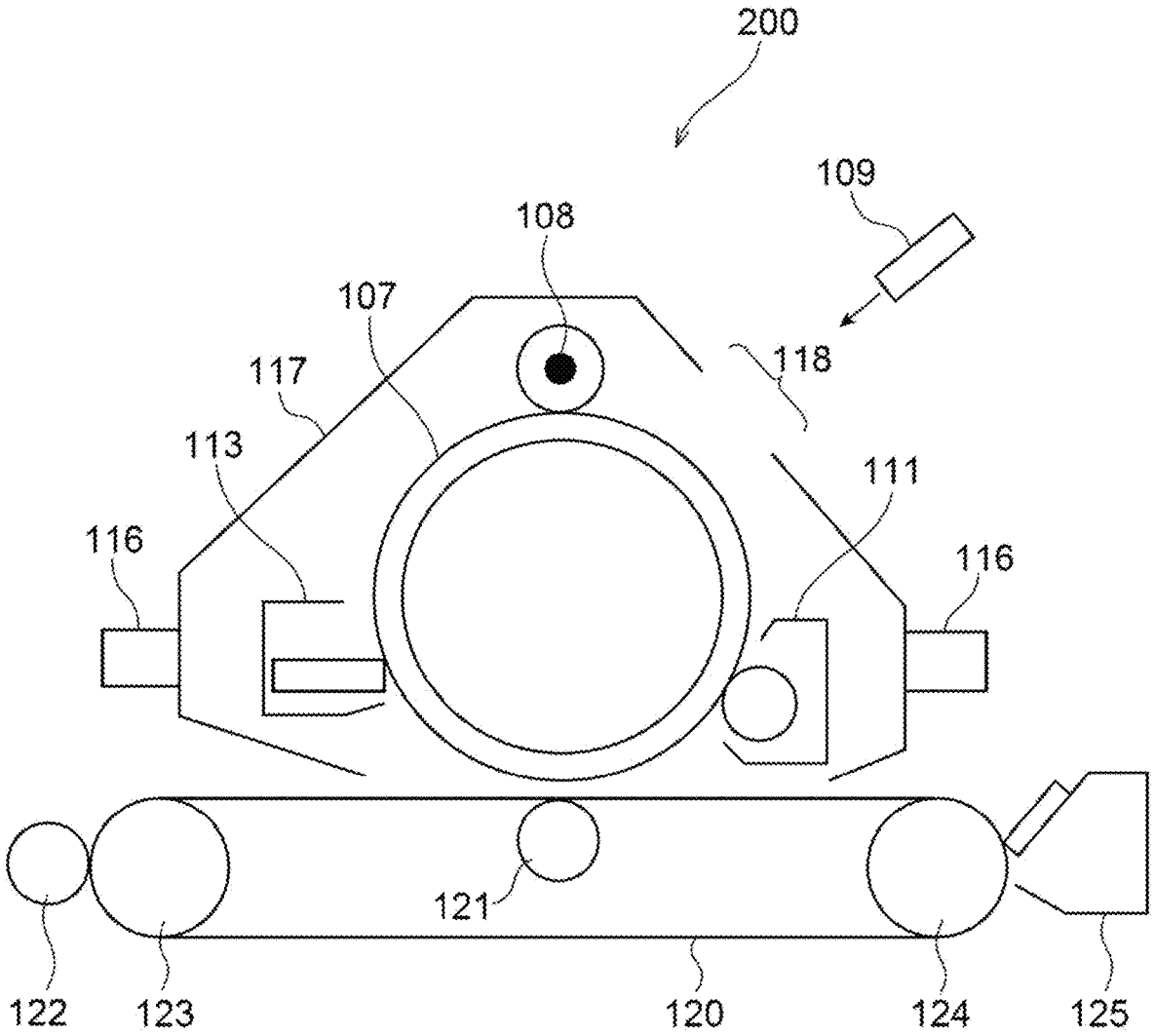
FIG. 3 is a schematic configuration diagram showing an example of a process cartridge detachably attached to the image forming apparatus according to the present embodiment.

FIG. 3 is a schematic configuration diagram showing an example of a process cartridge detachably attached to the image forming apparatus according to the present embodiment. In the process cartridge 200 shown in FIG. 3, a photoreceptor 107 (an example of the image holder), a charging roll 108 (an example of the charging unit) provided around the photoreceptor 107, a developing device 111 (an example of the developing unit), and a photoreceptor cleaning device 113 (an example of the image holder cleaning unit) are integrated with a casing 117 including a mounting rail 116 and an open portion 118 for exposure, and further, an intermediate transfer belt 120 (an example of the intermediate transfer member), a primary transfer roll 121 (an example of the primary transfer unit), a secondary transfer roll 122 (an example of the secondary transfer unit), a support roll 123, a drive roll 124, and an intermediate transfer member cleaning device 125 (an example of the intermediate transfer member cleaning unit) are combined. The photoreceptor cleaning device 113 includes a cleaning blade in contact with the photoreceptor 107. The intermediate transfer member cleaning device 125 includes a blade in contact with the intermediate transfer belt 120. When the photoreceptor 107 is disposed in the image forming apparatus to form an image, the photoreceptor 107 is exposed by an exposure device 109 (an example of the electrostatic charge image forming unit) to form an electrostatic image on the surface.

Next, the toner cartridge according to the present embodiment is described.

The toner cartridge according to the present embodiment is a toner cartridge housing the toner according to the present embodiment and detachably attached to the image forming apparatus. The toner cartridge houses a replenishment toner to be supplied to the developing unit provided in the image forming apparatus.

The image forming apparatus shown FIG. 2 is an image forming apparatus in which the toner cartridges 8Y, 8M, 8C and 8K are detachably attached. The developing devices 4Y, 4M, 4C, and 4K are connected to the toner cartridges corresponding to the respective developing devices (colors) by a toner supply pipe (not shown). In a case where the amount of toner housed in the toner cartridge decreases, the toner cartridge is replaced.

Example

Hereinafter, embodiments of the present disclosure are described in detail by examples, but the exemplary embodiments of the invention are not limited to these examples at all. In the following description, "parts" and "%" are all based on mass unless otherwise specified.

<Preparation of Strontium Titanate Particle A>

[Strontium Titanate Particle A(1)]

0.7 mol of metatitanic acid, as a desulfurized and deflocculated titanium source, is taken as $TiO_2$, and is charged into a reaction vessel. Then, to the reaction vessel, an aqueous strontium chloride solution is added in an amount of 0.77 mol such that a molar ratio of $SrO/TiO_2$ is 1.1. In the mixed solution of the two materials, the initial concentration of $TiO_2$ is 0.75 mol/L. Next, the mixed solution is stirred and heated to 120° C. While maintaining the solution temperature at 120° C., 153 mL of a 10N aqueous sodium hydroxide solution is added over 4 hours with stirring. Further, stirring is continued for 1 hour while maintaining the solution temperature at 120° C. Subsequently, the reaction solution is cooled to 40° C., hydrochloric acid is added until the pH reached 5.5, and the mixture is stirred for 1 hour. Then, the precipitate is washed by repeating decantation and redispersion in water. Hydrochloric acid is added to the slurry containing the washed precipitate to adjust the pH to 6.5, and the solid content is filtered and dried to obtain strontium titanate particles A(1).

[Strontium Titanate Particles A(2) to A(12)]

The strontium titanate particles A(2) to A(12) are prepared in the same manner as the preparation of the strontium titanate particles A(1), except that the time for the dropwise addition of the 10N aqueous sodium hydroxide solution is changed to the time described in Table 1.

<Measurement of Particle Diameter of Strontium Titanate Particle A>

A separately prepared toner particle and one of the strontium titanate particles A(1) to A(12) are mixed using a Henschel mixer at a stirring circumferential speed of 30 m/s for 15 minutes. Then, the particles are sieved using a vibrating sieve having an opening of 45 μm to obtain an externally added toner to which the strontium titanate particle A is adhered.

With respect to the above externally added toner, an image is taken at a magnification of 40,000 times using a scanning electron microscope (SEM) (S-4700, manufactured by Hitachi High-Technologies Corporation). Image information on randomly selected 300 strontium titanate particles A is analyzed using image processing analysis software WinRoof (MITANI CORPORATION) via an interface, and the circle equivalent diameter of each primary particle image is obtained. Then, the circle equivalent diameter that becomes 50% of accumulation from a small diameter side in the circle equivalent diameter distribution is taken as the average primary particle diameter.

[Measurement of Specific Volume Resistivity Ra of Strontium Titanate Particle A]

The strontium titanate particles A(1) to A(12) before being externally added to the toner particle are sampled separately, and the specific volume resistivity Ra (Ω·cm) thereof is obtained according to the above method.

<Preparation of Strontium Titanate Particle B>

[Strontium Titanate Particle B(1)]

0.7 mol of metatitanic acid, as a desulfurized and deflocculated titanium source, is taken as $TiO_2$, and is charged into a reaction vessel. Then, to the reaction vessel, an aqueous strontium chloride solution is added in an amount of 0.77 mol such that a molar ratio of $SrO/TiO_2$ is 1.1. Next, to the reaction vessel, a solution of lanthanum oxide dissolved in nitric acid is added in an amount of 2.5 mol of lanthanum based on 100 mol of strontium. In the mixed solution of the three materials, the initial concentration of $TiO_2$ is 0.75 mol/L. Next, the mixed solution is stirred and heated to 90° C. While maintaining the solution temperature at 90° C., 153 mL of a 10N aqueous sodium hydroxide solution is added over 3.8 hours with stirring. Further, stirring is continued for 1 hour while maintaining the solution temperature at 90° C. Subsequently, the reaction solution is cooled to 40° C., hydrochloric acid is added until the pH reached 5.5, and the mixture is stirred for 1 hour. Then, the precipitate is washed by repeating decantation and redispersion in water.

Hydrochloric acid is added to the slurry containing the washed precipitate to adjust the pH to 6.5, and the solid content is filtered and dried. An ethanol solution of 1,1,1,3,3,3-hexamethyldisilazane (HMDS) is added to the dried solid content in an amount such that the amount of HMDS is 20 parts based on 100 parts of the solid content, and the mixture is stirred for 1 hour. The solid content is filtered and then dried in the atmosphere at 130° C. for 7 hours to obtain strontium titanate particles B(1).

[Strontium Titanate Particle B(2)]

The strontium titanate particles B(2) are prepared in the same manner as the preparation of the strontium titanate particles B(1), except that the surface treatment using HMDS is not performed.

[Strontium Titanate Particle B(3)]

The strontium titanate particles B(3) are prepared in the same manner as the preparation of the strontium titanate particles B(1), except that the amount of lanthanum added is 9.5 mol based on 100 mol of strontium.

[Strontium Titanate Particle B(4)]

The strontium titanate particles B(4) are prepared in the same manner as the preparation of the strontium titanate particles B(1), except that the amount of lanthanum added is 0.5 mol based on 100 mol of strontium.

[Strontium Titanate Particle B(5)]

The strontium titanate particles B(5) are prepared in the same manner as the preparation of the strontium titanate particles B(1), except that in order to change the element to be doped from lanthanum to niobium, the solution of lanthanum oxide dissolved in nitric acid is changed to a solution of niobium oxide dissolved in nitric acid, and the solution of niobium oxide dissolved in nitric acid is added in an amount of 2.5 mol of niobium based on 100 mol of strontium.

[Strontium Titanate Particle B(6)]

The strontium titanate particles B(6) are prepared in the same manner as the preparation of the strontium titanate particles B(1), except that the time for the dropwise addition of the 10N aqueous sodium hydroxide solution is changed to 1 hour.

[Strontium Titanate Particle B(7)]

The strontium titanate particles B(7) are prepared in the same manner as the preparation of the strontium titanate particles B(1), except that the time for the dropwise addition of the 10N aqueous sodium hydroxide solution is changed to 9.5 hours.

[Strontium Titanate Particle B(8)]

The strontium titanate particles B(8) are prepared in the same manner as the preparation of the strontium titanate particles B(1), except that the time for the dropwise addition of the 10N aqueous sodium hydroxide solution is changed to 12 hours.

[Strontium Titanate Particle B(9)]

The strontium titanate particles B(9) are prepared using the strontium titanate particle A(1) as a base particle, and applying the surface treatment same as the HMDS treatment in the preparation of the strontium titanate particles B(1).

<Shape Measurement of Strontium Titanate Particle B>

A separately prepared toner particle and one of the strontium titanate particles B(1) to B(9) are mixed using a Henschel mixer at a stirring circumferential speed of 30 in/s for 15 minutes. Then, the particles are sieved using a vibrating sieve having an opening of 45 μm to obtain an externally added toner to which the strontium titanate particles B is adhered.

With respect to the above externally added toner, an image is taken at a magnification of 40,000 times using a scanning electron microscope (SEM) (S-4700, manufactured by Hitachi High-Technologies Corporation). Image information on randomly selected 300 strontium titanate particles B is analyzed using image processing analysis software WinRoof (MITANI CORPORATION) via an interface, the circle equivalent diameter, area and perimeter of each primary particle image are obtained, and the circularity is obtained according to circularity=$4\pi\times(\text{area})/(\text{perimeter})^2$. Then, the circle equivalent diameter that becomes 50% of accumulation from a small diameter side in the circle equivalent diameter distribution is taken as the average primary particle diameter; the circularity that becomes 50% of accumulation from a small side in the circularity distribution is taken as the average circularity; and the circularity that becomes 84% of accumulation from a small side in the circularity distribution is taken as the circularity that becomes 84%.

[X-Ray Diffraction of Strontium Titanate Particle B]

The strontium titanate particles B(1) to B(9) before being externally added to the toner particle are sampled separately, and crystal structure analysis is performed using an X-ray diffractometer (trade name: RINT Ultima-III manufactured by Rigaku Corporation) under the above condition settings. The strontium titanate particles B(1) to B(9) had a peak corresponding to the peak of the 110 plane of the perovskite crystal near the diffraction angle 28=32°.

[Measurement of Specific Volume Resistivity Rb of Strontium Titanate Particle B]

The strontium titanate particles B(l) to B(9) before being externally added to the toner particle are sampled separately, and the specific volume resistivity Rb (Ω·cm) thereof is obtained according to the above method.

<Preparation of Toner Particle>

—Formulation of Resin Particle Dispersion Solution (1)—

Terephthalic acid: 30 parts by mole

Fumaric acid: 70 parts by mole

Bisphenol A ethylene oxide adduct: 5 parts by mole

Bisphenol A propylene oxide adduct: 95 parts by mole

To a flask equipped with a stirrer, a nitrogen inlet tube, a temperature sensor and a rectification column, the above materials are charged. The temperature is raised to 220° C. for 1 hour, and 1 part of titanium tetraethoxide is added based on 100 parts of the above materials. The temperature is raised to 230° C. for 30 minutes while distilling the generated water, the dehydration condensation reaction is continued for 1 hour at this temperature, and then the reaction product is cooled. In this way, a polyester resin having a weight average molecular weight of 18,000 and a glass transition temperature of 60° C. is obtained.

To a container equipped with a temperature control unit and a nitrogen substitution unit, 40 parts of ethyl acetate and 25 parts of 2-butanol are charged. After obtaining a mixed solvent, 100 parts of the polyester resin is slowly added and dissolved, and a 10 mass % ammonia aqueous solution (equivalent to 3 times the molar ratio based on the acid value of the resin) is added thereto and stirred for 30 minutes. Next, the interior of the container is substitute with dry nitrogen, the temperature is maintained at 40° C., 400 parts of ion exchanged water is added dropwise at a rate of 2 parts/min while stirring the mixed solution. After the completion of the dropwise addition, the temperature is returned to room temperature (20° C. to 25° C.) and bubbling is performed with dry nitrogen for 48 hours while stirring, so as to obtain a resin particle dispersion solution in which ethyl acetate and 2-butanol are reduced to 1000 ppm or less. Ion exchanged water is added to the resin particle dispersion solution, and the solid content is adjusted to 20 mass % to obtain a resin particle resin particle dispersion solution (1).

—Formulation of Colorant Particle Dispersion Solution (1)—

C. I. Pigment Blue 15:3 (Dainichiseika Color & Chemicals Mfg. Co., Ltd.): 70 parts Anionic surfactant (Neogen RK manufactured by DKS Co. Ltd.): 5 parts Ion exchanged water: 200 parts The above materials are mixed, and are dispersed using a homogenizer (trade name: Ultra Turrax T50, manufactured by IKA company) for 10 minutes. Ion exchanged water is added such that the solid content in the dispersion solution is 20 mass %, so as to obtain a colorant particle dispersion solution (1) in which colorant particles having a volume average particle diameter of 170 nm are dispersed.

—Formulation of Releasing Agent Particle Dispersion Solution (1)—

Paraffin wax (HNP-9 manufactured by NIPPON SEIRO CO., LTD.): 100 parts

Anionic surfactant (Neogen RK manufactured by DKS Co. Ltd.): 1 parts

Ion exchanged water: 350 parts

The above materials are mixed and heated to 100° C., and then dispersed using a homogenizer (trade name: Ultra Turrax T50, manufactured by IKA company). Thereafter, the mixture is dispersed with a Manton-Gaulin high-pressure homogenizer (Gaulin Company), so as to obtain a releasing agent particle dispersion solution (1) (solid content: 20 mass %) in which releasing agent particles having a volume average particle diameter of 200 nm are dispersed.

—Preparation of Toner Particle (1)—

Resin particle dispersion solution (1): 403 parts

Colorant particle dispersion solution (1): 12 parts

Releasing agent particle dispersion solution (1): 50 parts

Anionic surfactant (Taycapower): 2 parts

The above materials are charged to a round stainless steel flask, pH is adjusted to 3.5 by adding 0.1N nitric acid, and then 30 parts of a nitric acid aqueous solution having a polyaluminum chloride concentration of 10 mass % is added. Next, the mixture is dispersed at a solution temperature of 30° C. using a homogenizer (trade name: Ultra Turrax T50, manufactured by IKA company), and thereafter is heated to 45° C. in a heating oil bath and maintained for 30 minutes. Thereafter, 100 parts of the resin particle dispersion solution (1) is added and maintained for 1 hour, the pH is adjusted to 8.5 by adding a 0.1N aqueous sodium hydroxide solution, and then the mixture is heated to 84° C. and maintained for 2.5 hours. Subsequently, the mixture is cooled to 20° C. at a rate of 20° C./min, the solid content is filtered, thoroughly washed with ion exchanged water, and dried to obtain toner particles (1). The toner particle (1) had a volume average particle diameter of 5.7 μm.

<Preparation of Carrier>

Ferrite particle (average particle diameter: 35 μm): 100 parts

Toluene: 14 parts

Styrene/methyl methacrylate copolymer (copolymerization ratio: 15/85): 2 parts

Carbon black: 0.2 part

The above materials excluding the ferrite particle are dispersed with a sand mill to formulate a dispersion solution. The dispersion solution is charged in a vacuum degassing type kneader together with the ferrite particle, and dried under reduced pressure while stirring, so as to obtain a carrier.

<Preparation of Toner and Developer: Examples 1 to 54 and Comparative Examples 1 to 17>

To 100 parts of the toner particle (1), any one of the strontium titanate particles A(1) to A(12), and any one of the strontium titanate particles B(1) to B(9) are added in combination and in amounts shown in Tables 3 to 4, and mixed for 15 minutes at a stirring circumferential speed of 30 m/s using a Henschel mixer. Next, the mixture is sieved using a vibrating sieve having an opening of 45 μm to obtain an externally added toner.

To a V blender, 10 parts of the externally added toner and 100 parts of the carrier are charged, and stirred for 20 minutes. Thereafter, the mixture is sieved using a sieve having an opening of 212 μm to obtain a developer.

<Evaluation on Toner and Developer>

A 700 Digital Color Press modified machine manufactured by Fuji Xerox Co., Ltd. is charged with the developer, and is allowed to stand for 24 hours under a high temperature and high humidity environment (temperature 28° C./relative humidity 85%). Thereafter, under the same high temperature and high humidity environment, 100,000 images having an image area proportion of 70% are continuously outputted on A4-size plain papers, and then 10 halftone images are outputted. After the images are formed, the surface of each of the photoreceptor and the transfer belt is visually observed, and 10 halftone images are visually observed. The degree of contamination of the members is classified as follows.

—Contamination of Photoreceptor—

A: No adhered substance is observed on the surface of the photoreceptor, and no image defect of image untransfer is observed.

B: No adhered substance is observed on the surface of the photoreceptor, and only image defect of image untransfer is observed.

C: Adhered substances are observed on the surface of the photoreceptor, and image defects of image untransfer are observed, but within an allowable range.

D: Adhered substances are observed on the surface of the photoreceptor, and image defects of image untransfer are observed in an unallowable range.

—Contamination of Transfer Belt—

A: No adhered substance is observed on the surface of the transfer belt, and no color strip is observed on the image.

B: No adhered substance is observed on the surface of the transfer belt, and only color strip is observed on the image.

C: Adhered substances are observed on the surface of the transfer belt, and color strips are observed on the image, but within an allowable range.

D: Adhered substances are observed on the surface of the transfer belt, and color strips are observed on the image in an unallowable range.

Table 1 shows properties of the strontium titanate particles A(1) to A(12). Table 2 shows properties of the strontium titanate particles B(1) to B(9). The composition, physical properties and evaluation results of each Example and each Comparative Example are shown in Tables 3 to 4.

TABLE 1

| Strontium titanate particles A | Time for dropwise addition of 10N aqueous sodium hydroxide solution [hour] | Average primary particle diameter Da [μm] | Common logarithm value log of specific volume resistivity Ra |
|---|---|---|---|
| (1) | 4 | 0.13 | 8.7 |
| (2) | 5 | 0.25 | 8.7 |
| (3) | 6 | 0.38 | 8.7 |
| (4) | 8 | 0.75 | 8.7 |
| (5) | 10 | 1.13 | 8.7 |
| (6) | 11 | 1.25 | 8.7 |
| (7) | 15 | 2.25 | 8.7 |
| (8) | 16 | 2.50 | 8.7 |
| (9) | 17 | 2.75 | 8.7 |
| (10) | 20 | 3.75 | 8.7 |
| (11) | 24 | 4.50 | 8.7 |
| (12) | 28 | 5.50 | 8.7 |

TABLE 2

| Strontium titanate particles B | Dopant | Dope amount [mol %] | Surface treatment agent | Average primary particle diameter Db [nm] | Average circularity | Circularity that becomes 84% of accumulation | Full width at half maximun of peak of 110 plane | Common logarithm value log of specific volume resistivity Rb |
|---|---|---|---|---|---|---|---|---|
| (1) | La | 2.5 | HMDS | 50 | 0.880 | 0.935 | 0.35 | 12.5 |
| (2) | La | 2.5 | — | 50 | 0.880 | 0.935 | 0.35 | 8.5 |
| (3) | La | 9.5 | HMDS | 50 | 0.940 | 0.950 | 0.55 | 12.0 |
| (4) | La | 0.5 | HMDS | 50 | 0.860 | 0.925 | 0.22 | 12.0 |
| (5) | Nb | 2.5 | HMDS | 50 | 0.890 | 0.940 | 0.37 | 12.8 |
| (6) | La | 2.5 | HMDS | 25 | 0.920 | 0.954 | 0.70 | 12.5 |
| (7) | La | 2.5 | HMDS | 75 | 0.845 | 0.930 | 0.30 | U.S |
| (8) | La | 2.5 | HMDS | 85 | 0.836 | 0.925 | 0.26 | 12.5 |
| (9) | — | 0 | HMDS | 130 | 0.880 | 0.900 | 0.15 | 12.5 |

TABLE 3

| | Strontium titanate particles B | | | | | | | |
|---|---|---|---|---|---|---|---|---|
| | Type | Surface treatment agent | Average primary particle diameter Db [nm] | Average circularity | Circularity that becomes 84% of accumulation | Full width at half maximum of peak of 110 plane | LogRb | Externally added amount Mb Parts based on 100 parts of toner particle |
| Comparative Example 1 | (1) | HMDS | 50 | 0.880 | 0.935 | 0.35 | 12.5 | 2.0 |
| Example 1 | (1) | HMDS | 50 | 0.880 | 0.935 | 0.35 | 12.5 | 2.0 |
| Example 2 | (1) | HMDS | 50 | 0.880 | 0.935 | 0.35 | 12.5 | 2.0 |
| Example 3 | (1) | HMDS | 50 | 0.880 | 0.935 | 0.35 | 12.5 | 2.0 |
| Extunple 4 | (1) | HMDS | 50 | 0.880 | 0.935 | 0.35 | 12.5 | 0.8 |
| Example 5 | (1) | HMDS | 50 | 0.880 | 0.935 | 0.35 | 12.5 | 3.5 |
| Example 6 | (1) | HMDS | 50 | 0.880 | 0.935 | 0.35 | 12.5 | 2.0 |
| Example 7 | (1) | HMDS | 50 | 0.880 | 0.935 | 0.35 | 12.5 | 2.0 |
| Comparative Example 2 | (1) | HMDS | 50 | 0.880 | 0.935 | 0.35 | 12.5 | 2.0 |
| Comparative Example 3 | (2) | — | 50 | 0.880 | 0.935 | 0.35 | 8.5 | 2.0 |
| Example 8 | (2) | — | 50 | 0.880 | 0.935 | 0.35 | 8.5 | 2.0 |
| Example 9 | (2) | — | 50 | 0.880 | 0.935 | 0.35 | 8.5 | 2.0 |
| Example 10 | (2) | — | 50 | 0.880 | 0.935 | 0.35 | 8.5 | 2.0 |
| Example 11 | (2) | — | 50 | 0.880 | 0.935 | 0.35 | 8.5 | 0.8 |
| Example 12 | (2) | — | 50 | 0.880 | 0.935 | 0.35 | 8.5 | 3.5 |
| Example 13 | (2) | — | 50 | 0.880 | 0.935 | 0.35 | 8.5 | 2.0 |
| Example 14 | (2) | — | 50 | 0.880 | 0.935 | 0.35 | 8.5 | 2.0 |
| Comparative Example 4 | (2) | — | 50 | 0.880 | 0.935 | 0.35 | 8.5 | 2.0 |
| Comparative Example 5 | (3) | HMDS | 50 | 0.940 | 0.950 | 0.55 | 12.0 | 2.0 |
| Example 15 | (3) | HMDS | 50 | 0.940 | 0.950 | 0.55 | 12.0 | 2.0 |
| Example 16 | (3) | HMDS | 50 | 0.940 | 0.950 | 0.55 | 12.0 | 2.0 |
| Example 17 | (3) | HMDS | 50 | 0.940 | 0.950 | 0.55 | 12.0 | 2.0 |
| Example 18 | (3) | HMDS | 50 | 0.940 | 0.950 | 0.55 | 12.0 | 0.8 |
| Example 19 | (3) | HMDS | 50 | 0.940 | 0.950 | 0.55 | 12.0 | 3.5 |
| Example 20 | (3) | HMDS | 50 | 0.940 | 0.950 | 0.55 | 12.0 | 2.0 |
| Example 21 | (3) | HMDS | 50 | 0.940 | 0.950 | 0.55 | 12.0 | 2.0 |
| Comparative Example 6 | (3) | HMDS | 50 | 0.940 | 0.950 | 0.55 | 12.0 | 2.0 |
| Comparative Example 7 | (4) | HMDS | 50 | 0.860 | 0.925 | 0.22 | 12.0 | 2.0 |
| Example 22 | (4) | HMDS | 50 | 0.860 | 0.925 | 0.22 | 12.0 | 2.0 |
| Example 23 | (4) | HMDS | 50 | 0.860 | 0.925 | 0.22 | 12.0 | 2.0 |
| Example 24 | (4) | HMDS | 50 | 0.860 | 0.925 | 0.22 | 12.0 | 2.0 |
| Example 25 | (4) | HMDS | 50 | 0.860 | 0.925 | 0.22 | 12.0 | 0.8 |

TABLE 3-continued

| | | | | | | | | |
|---|---|---|---|---|---|---|---|---|
| Example 26 | (4) | HMDS | 50 | 0.860 | 0.925 | 0.22 | 12.0 | 3.5 |
| Example 27 | (4) | HMDS | 50 | 0.860 | 0.925 | 0.22 | 12.0 | 2.0 |
| Example 28 | (4) | HMDS | 50 | 0.860 | 0.925 | 0.22 | 12.0 | 2.0 |
| Comparative Example 8 | (4) | HMDS | 50 | 0.860 | 0.925 | 0.22 | 12.0 | 2.0 |

| | Strontium titanate particle A | | | | | | | | |
|---|---|---|---|---|---|---|---|---|---|
| | Type | Average primary particle diameter Da [nm] | LogRa | Externally added amount Mb Parts based on 100 parts of toner particle | Da/Db | Ra/Rb | Ma/Mb | Contamination of photoreceptor | Contamination of transfer belt |
| Comparative Example 1 | (2) | 0.25 | 8.7 | 0.1 | 5 | 0.70 | 20 | D | D |
| Example 1 | (4) | 0.75 | 8.7 | 0.1 | 15 | 0.70 | 20 | C | A |
| Example 2 | (6) | 1.25 | 8.7 | 0.1 | 25 | 0.70 | 20 | A | A |
| Example 3 | (8) | 2.50 | 8.7 | 0.1 | 50 | 0.70 | 20 | A | A |
| Extunple 4 | (8) | 2.50 | 8.7 | 0.6 | 50 | 0.70 | 1.3 | B | C |
| Example 5 | (8) | 2.50 | 8.7 | 0.05 | 50 | 0.70 | 70 | A | B |
| Example 6 | (10) | 3.75 | 8.7 | 0.1 | 75 | 0.70 | 20 | C | B |
| Example 7 | (11) | 4.50 | 8.7 | 0.1 | 90 | 0.70 | 20 | D | B |
| Comparative Example 2 | (12) | 5.50 | 8.7 | 0.1 | 110 | 0.70 | 20 | D | D |
| Comparative Example 3 | (2) | 0.25 | 8.7 | 0.1 | 5 | 1.02 | 20 | D | D |
| Example 8 | (4) | 0.75 | 8.7 | 0.1 | 15 | 1.02 | 20 | C | C |
| Example 9 | (6) | 1.25 | 8.7 | 0.1 | 25 | 1.02 | 20 | A | C |
| Example 10 | (8) | 2.50 | 8.7 | 0.1 | 50 | 1.02 | 20 | A | C |
| Example 11 | (8) | 2.50 | 8.7 | 0.6 | 50 | 1.02 | 1.3 | B | C |
| Example 12 | (8) | 2.50 | 8.7 | 0.05 | 50 | 1.02 | 70 | A | C |
| Example 13 | (10) | 3.75 | 8.7 | 0.1 | 75 | 1.02 | 20 | C | C |
| Example 14 | (11) | 4.50 | 8.7 | 0.1 | 90 | 1.02 | 20 | D | C |
| Comparative Example 4 | (12) | 5.50 | 8.7 | 0.1 | 110 | 1.02 | 20 | D | D |
| Comparative Example 5 | (2) | 0.25 | 8.7 | 0.1 | 5 | 0.73 | 20 | D | D |
| Example 15 | (4) | 0.75 | 8.7 | 0.1 | 15 | 0.73 | 20 | C | A |
| Example 16 | (6) | 1.25 | 8.7 | 0.1 | 25 | 0.73 | 20 | A | A |
| Example 17 | (8) | 2.50 | 8.7 | 0.1 | 50 | 0.73 | 20 | A | A |
| Example 18 | (8) | 2.50 | 8.7 | 0.6 | 50 | 0.73 | 1.3 | B | C |
| Example 19 | (8) | 2.50 | 8.7 | 0.05 | 50 | 0.73 | 70 | A | B |
| Example 20 | (10) | 3.75 | 8.7 | 0.1 | 75 | 0.73 | 20 | C | B |
| Example 21 | (11) | 4.50 | 8.7 | 0.1 | 90 | 0.73 | 20 | D | B |
| Comparative Example 6 | (12) | 5.50 | 8.7 | 0.1 | 110 | 0.73 | 20 | D | D |
| Comparative Example 7 | (2) | 0.25 | 8.7 | 0.1 | 5 | 0.73 | 20 | D | D |
| Example 22 | (4) | 0.75 | 8.7 | 0.1 | 15 | 0.73 | 20 | C | A |
| Example 23 | (6) | 1.25 | 8.7 | 0.1 | 25 | 0.73 | 20 | A | A |
| Example 24 | (8) | 2.50 | 8.7 | 0.1 | 50 | 0.73 | 20 | A | A |
| Example 25 | (8) | 7.50 | 8.7 | 0.6 | 50 | 0.73 | 1.3 | B | C |
| Example 26 | (8) | 2.50 | 8.7 | 0.05 | 50 | 0.73 | 70 | A | B |
| Example 27 | (10) | 3.75 | 8.7 | 0.1 | 75 | 0.73 | 20 | C | B |
| Example 28 | (11) | 4.50 | 8.7 | 0.1 | 90 | 0.73 | 20 | D | B |
| Comparative Example 8 | (12) | 5.50 | 8.7 | 0.1 | 110 | 0.73 | 20 | D | D |

TABLE 4

| | Strontium titanate particles B | | | | | | | |
|---|---|---|---|---|---|---|---|---|
| | Type | Surface treatment agent | Average primary particle diameter Db [nm] | Average circularity | Circularity that becomes 84% of accumulation | Full width at half maximum of peak of 110 plane | Log Rb | Externally added amount Mb Parts based on 100 parts of toner particle |
| Comparative Example 9 | (5) | HMDS | 50 | 0.890 | 0.940 | 0.37 | 12.8 | 2.0 |
| Example 29 | (5) | HMDS | 50 | 0.890 | 0.940 | 0.37 | 12.8 | 2.0 |

TABLE 4-continued

| | | | | | | | | |
|---|---|---|---|---|---|---|---|---|
| Example 30 | (5) | HMDS | 50 | 0.890 | 0.940 | 0.37 | 12.8 | 2.0 |
| Example 31 | (5) | HMDS | 50 | 0.890 | 0.940 | 0.37 | 12.8 | 2.0 |
| Example 32 | (5) | HMDS | 50 | 0.890 | 0.940 | 0.37 | 12.8 | 0.8 |
| Example 33 | (5) | HMDS | 50 | 0.890 | 0.940 | 0.37 | 12.8 | 3.5 |
| Example 34 | (5) | HMDS | 50 | 0.890 | 0.940 | 0.37 | 12.8 | 2.0 |
| Example 35 | (5) | HMDS | 50 | 0.890 | 0.940 | 0.37 | 12.8 | 2.0 |
| Comparative Example 10 | (5) | HMDS | 50 | 0.890 | 0.940 | 0.37 | 12.8 | 2.0 |
| Comparative Example 11 | (6) | HMDS | 25 | 0.920 | 0.954 | 0.70 | 12.5 | 2.0 |
| Example 36 | (6) | HMDS | 25 | 0.920 | 0.954 | 0.70 | 12.5 | 2.0 |
| Example 37 | (6) | HMDS | 25 | 0.920 | 0.954 | 0.70 | 12.5 | 2.0 |
| Example 38 | (6) | HMDS | 25 | 0.920 | 0.954 | 0.70 | 12.5 | 2.0 |
| Example 39 | (6) | HMDS | 25 | 0.920 | 0.954 | 0.70 | 12.5 | 0.8 |
| Example 40 | (6) | HMDS | 25 | 0.920 | 0.954 | 0.70 | 12.5 | 3.5 |
| Example 41 | (6) | HMDS | 25 | 0.920 | 0.954 | 0.70 | 12.5 | 2.0 |
| Example 42 | (6) | HMDS | 25 | 0.920 | 0.954 | 0.70 | 12.5 | 2.0 |
| Comparative Example 12 | (6) | HMDS | 25 | 0.920 | 0.954 | 0.70 | 12.5 | 2.0 |
| Comparative Example 13 | (7) | HMDS | 75 | 0.845 | 0.930 | 0.30 | 12.5 | 2.0 |
| Example 43 | (7) | HMDS | 75 | 0.845 | 0.930 | 0.30 | 12.5 | 2.0 |
| Example 44 | (7) | HMDS | 75 | 0.845 | 0.930 | 0.30 | 12.5 | 2.0 |
| Example 45 | (7) | HMDS | 75 | 0.845 | 0.930 | 0.30 | 12.5 | 2.0 |
| Example 46 | (7) | HMDS | 75 | 0.845 | 0.930 | 0.30 | 12.5 | 0.8 |
| Example 47 | (7) | HMDS | 75 | 0.845 | 0.930 | 0.30 | 12.5 | 3.5 |
| Example 48 | (7) | HMDS | 75 | 0.845 | 0.930 | 0.30 | 12.5 | 2.0 |
| Comparative Example 14 | (8) | HMDS | 85 | 0.836 | 0.925 | 0.26 | 12.5 | 2.0 |
| Example 49 | (8) | HMDS | 85 | 0.836 | 0.925 | 0.26 | 12.5 | 2.0 |
| Example 50 | (8) | HMDS | 85 | 0.836 | 0.925 | 0.26 | 12.5 | 2.0 |
| Example 51 | (8) | HMDS | 85 | 0.836 | 0.925 | 0.26 | 12.5 | 2.0 |
| Example 52 | (8) | HMDS | 85 | 0.836 | 0.925 | 0.26 | 12.5 | 0.8 |
| Example 53 | (8) | HMDS | 85 | 0.836 | 0.925 | 0.26 | 12.5 | 3.5 |
| Example 54 | (8) | HMDS | 85 | 0.836 | 0.925 | 0.26 | 12.5 | 2.0 |
| Comparative Example 15 | (9) | HMDS | 130 | 0.880 | 0.900 | 0.15 | 12.5 | 2.0 |
| Comparative Example 16 | (9) | HMDS | 130 | 0.880 | 0.900 | 0.15 | 12.5 | 2.0 |
| Comparative Example 17 | (9) | HMDS | 130 | 0.880 | 0.900 | 0.15 | 12.5 | 2.0 |

| | Strontium titanate particle A | | | | | | | | |
|---|---|---|---|---|---|---|---|---|---|
| | Type | Average primary particle diameter Da [nm] | Log Ra | Externally added amount Mb Parts based on 100 parts of toner particle | Da/Db | Ra/Rb | Ma/Mb | Contamination of photoreceptor | Contamination of transfer belt |
| Comparative Example 9 | (2) | 0.25 | 8.7 | 0.1 | 5 | 0.68 | 20 | D | D |
| Example 29 | (4) | 0.75 | 8.7 | 0.1 | 15 | 0.68 | 20 | C | A |
| Example 30 | (6) | 1.25 | 8.7 | 0.1 | 25 | 0.68 | 20 | A | A |
| Example 31 | (8) | 2.50 | 8.7 | 0.1 | 50 | 0.68 | 20 | A | A |
| Example 32 | (8) | 2.50 | 8.7 | 0.6 | 50 | 0.68 | 1.3 | B | C |
| Example 33 | (8) | 2.50 | 8.7 | 0.05 | 50 | 0.68 | 70 | A | B |
| Example 34 | (10) | 3.75 | 8.7 | 0.1 | 75 | 0.68 | 20 | C | B |
| Example 35 | (11) | 4.50 | 8.7 | 0.1 | 90 | 0.68 | 20 | D | B |
| Comparative Example 10 | (12) | 5.50 | 8.7 | 0.1 | 110 | 0.68 | 20 | D | D |
| Comparative Example 11 | (1) | 0.13 | 8.7 | 0.1 | 5.2 | 0.70 | 20 | D | D |
| Example 36 | (3) | 0.38 | 8.7 | 0.1 | 15.2 | 0.70 | 20 | D | B |
| Example 37 | (4) | 0.75 | 8.7 | 0.1 | 30 | 0.70 | 20 | C | B |
| Example 38 | (6) | 1.25 | 8.7 | 0.1 | 50 | 0.70 | 20 | A | B |
| Example 39 | (6) | 1.25 | 8.7 | 0.6 | 50 | 0.70 | 1.3 | B | C |

TABLE 4-continued

| | | | | | | | | | |
|---|---|---|---|---|---|---|---|---|---|
| Example 40 | (6) | 1.25 | 8.7 | 0.05 | 50 | 0.70 | 70 | A | C |
| Example 41 | (7) | 2.25 | 8.7 | 0.1 | 90 | 0.70 | 20 | A | C |
| Example 42 | (8) | 2.50 | 8.7 | 0.1 | 100 | 0.70 | 20 | A | C |
| Comparative Example 12 | (9) | 2.75 | 8.7 | 0.1 | 110 | 0.70 | 20 | A | D |
| Comparative Example 13 | (3) | 0.38 | 8.7 | 0.1 | 5.1 | 0.70 | 20 | D | D |
| Example 43 | (5) | 1.13 | 8.7 | 0.1 | 15.1 | 0.70 | 20 | A | B |
| Example 44 | (8) | 2.50 | 8.7 | 0.1 | 33.3 | 0.70 | 20 | A | B |
| Example 45 | (10) | 3.75 | 8.7 | 0.1 | 50 | 0.70 | 20 | C | C |
| Example 46 | (10) | 3.75 | 8.7 | 0.6 | 50 | 0.70 | 1.3 | C | C |
| Example 47 | (10) | 3.75 | 8.7 | 0.05 | 50 | 0.70 | 70 | C | D |
| Example 48 | (11) | 4.50 | 8.7 | 0.1 | 60 | 0.70 | 20 | D | D |
| Comparative Example 14 | (4) | 0.75 | 8.7 | 0.1 | 8.8 | 0.70 | 20 | C | D |
| Example 49 | (8) | 1.25 | 8.7 | 0.1 | 14.7 | 0.70 | 20 | A | B |
| Example 50 | (8) | 2.50 | 8.7 | 0.1 | 29.4 | 0.70 | 20 | A | B |
| Example 51 | (11) | 4.50 | 8.7 | 0.1 | 52.9 | 0.70 | 20 | D | B |
| Example 52 | (11) | 4.50 | 8.7 | 0.6 | 52.9 | 0.70 | 1.3 | D | C |
| Example 53 | (11) | 4.50 | 8.7 | 0.05 | 52.9 | 0.70 | 70 | D | D |
| Example 54 | (12) | 5.50 | 8.7 | 0.1 | 64.7 | 0.70 | 20 | D | B |
| Comparative Example 15 | (4) | 0.75 | 8.7 | 0.1 | 5.8 | 0.70 | 20 | C | D |
| Comparative Example 16 | (7) | 2.25 | 8.7 | 0.1 | 17.3 | 0.70 | 20 | A | D |
| Comparative Example 17 | (10) | 3.75 | 8.7 | 0.1 | 28.8 | 0.70 | 20 | C | D |

The foregoing description of the exemplary embodiments of the present disclosure has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and strontium titanate particles A and strontium titanate particles B having different average primary particle diameters from each other, wherein the strontium titanate particles B have an average primary particle diameter Db of 10 nm to 100 nm, wherein an average primary particle diameter Da of the strontium titanate particles A and the average primary particle diameter Db of the strontium titanate particles B satisfy a relationship of $10 \leq Da/Db \leq 100$, wherein the average primary particle diameter Da of the strontium titanate particles A is 1.0 μm to 3.0 μm.

2. The electrostatic charge image developing toner according to claim 1, wherein the average primary particle diameter Da and the average primary particle diameter Db satisfy a relationship of $15 \leq Da/Db \leq 50$.

3. The electrostatic charge image developing toner according to claim 1, wherein the strontium titanate particles B are strontium titanate particles containing a dopant.

4. The electrostatic charge image developing toner according to claim 1, wherein the average primary particle diameter Da of the strontium titanate particles A is smaller than a volume average particle diameter of the toner particle.

5. The electrostatic charge image developing toner according to claim 1, wherein the strontium titanate particles A are strontium titanate particles whose surfaces are not hydrophobically treated, and wherein the strontium titanate particles B are strontium titanate particles whose surfaces are hydrophobically treated.

6. An electrostatic charge image developing toner comprising:

toner particles; and strontium titanate particles A and strontium titanate particles B having different average primary particle diameters from each other, wherein primary particles of the strontium titanate particles B have an average circularity of 0.82 to 0.94 and a circularity that becomes 84% of accumulation of greater than 0.92, wherein an average primary particle diameter Da of the strontium titanate particles A and an average primary particle diameter Db of the strontium titanate particles B satisfy a relationship of $10 \leq Da/Db \leq 100$, wherein the strontium titanate particles A have an average primary particle diameter Da of 1.0 μm to 3.0 μm, and wherein the strontium titanate particles B have an average primary particle diameter Db of 10 nm to 100 nm.

7. The electrostatic charge image developing toner according to claim 6, wherein the average primary particle diameter Da and the average primary particle diameter Db satisfy a relationship of $15 \leq Da/Db \leq 50$.

8. The electrostatic charge image developing toner according to claim 6, wherein the strontium titanate particles B are strontium titanate particles containing a dopant.

9. The electrostatic charge image developing toner according to claim 6, wherein the average primary particle diameter Da of the strontium titanate particles A is smaller than a volume average particle diameter of the toner particle.

10. The electrostatic charge image developing toner according to claim 6, wherein the strontium titanate particles A are strontium titanate particles whose surfaces are not hydrophobically treated, and wherein the strontium titanate particles B are strontium titanate particles whose surfaces are hydrophobically treated.

11. The electrostatic charge image developing toner according to claim 6, wherein a content Ma of the strontium titanate particles A and a content Mb of the strontium titanate particles B satisfy a relationship of $10 \leq Mb/Ma \leq 150$, wherein the content Ma of the strontium titanate particles A is 0.02 part by mass to 1 part by mass based on 100 parts by mass of the toner particles, and wherein the content Mb of the strontium titanate particles B is 0.2 part by mass to 4.0 parts by mass based on 100 parts by mass of the toner particles.

12. An electrostatic charge image developer containing the electrostatic charge image developing toner according to claim 6.

13. An electrostatic charge image developing toner comprising:

toner particles; and strontium titanate particles A and strontium titanate particles B having different average primary particle diameters from each other, wherein a full width at half maximum of a peak of a 110 plane obtained by an X-ray diffraction method from the strontium titanate particles B is 0.2° to 2.0°, wherein an average primary particle diameter Da of the strontium titanate particles A and an average primary particle diameter Db of the strontium titanate particles B satisfy a relationship of $10 \leq Da/Db \leq 100$, wherein the strontium titanate particles A have an average primary particle diameter Da of 1.0 μm to 3.0 μm, and wherein the strontium titanate particles B have an average primary particle diameter Db of 10 nm to 100 nm.

14. The electrostatic charge image developing toner according to claim 13, wherein the average primary particle diameter Da and the average primary particle diameter Db satisfy a relationship of $15 \leq Da/Db \leq 50$.

15. The electrostatic charge image developing toner according to claim 13, wherein the strontium titanate particles B are strontium titanate particles containing a dopant.

16. The electrostatic charge image developing toner according to claim 13, wherein the average primary particle diameter Da of the strontium titanate particles A is smaller than a volume average particle diameter of the toner particle.

17. The electrostatic charge image developing toner according to claim 13, wherein the strontium titanate particles A are strontium titanate particles whose surfaces are not hydrophobically treated, and wherein the strontium titanate particles B are strontium titanate particles whose surfaces are hydrophobically treated.

* * * * *